US005384233A

United States Patent [19]

Kuse et al.

[11] Patent Number: 5,384,233

[45] Date of Patent: Jan. 24, 1995

[54] CHEMICALS KIT INCLUDING A CONTAINER FORMED OF MULTILAYER FILM, FOR PROCESSING PHOTOGRAPHIC LIGHT-SENSITIVE MATERIALS

[75] Inventors: Satoru Kuse; Hiroaki Kobayashi; Tsuyoshi Haraguchi; Hiroshi Yamashita, all of Hino, Japan

[73] Assignee: Konica Corporation, Tokyo, Japan

[21] Appl. No.: 73,350

[22] Filed: Jun. 7, 1993

[30] Foreign Application Priority Data

| | | | |
|---|---|---|---|
| Jun. 15, 1992 | [JP] | Japan | 4-155128 |
| Jun. 15, 1992 | [JP] | Japan | 4-155129 |
| Jun. 15, 1992 | [JP] | Japan | 4-155130 |
| Jun. 18, 1992 | [JP] | Japan | 4-159576 |

[51] Int. Cl.[6] ..... G03C 7/00; G03C 5/42; G03C 5/44; G03C 5/18

[52] U.S. Cl. ..... 430/461; 430/393; 430/430; 430/403; 430/498; 206/524.2; 206/524.9; 206/578; 428/34.4; 428/35.4; 428/36.6; 428/36.7

[58] Field of Search ..... 430/208, 403, 450, 498, 430/483, 484, 461, 465, 467, 430, 393; 428/34.7, 36.6, 36.7, 34.4, 35.4; 206/578, 524.2, 524.9

[56] References Cited

U.S. PATENT DOCUMENTS

| | | | |
|---|---|---|---|
| 2,688,548 | 9/1954 | Reynolds | 430/484 |
| 2,688,549 | 9/1954 | James et al. | 430/483 |
| 2,936,308 | 5/1960 | Hodge | 430/484 |
| 3,770,122 | 11/1973 | Thiele | 206/524.2 |
| 4,564,541 | 1/1986 | Tairo et al. | 428/35 |
| 4,627,844 | 12/1986 | Schmitt | 428/36.6 |
| 4,692,361 | 9/1987 | Johnston et al. | 428/35 |
| 4,702,963 | 10/1987 | Phillips et al. | 428/426 |
| 4,746,562 | 5/1988 | Fant | 428/213 |
| 4,791,013 | 12/1988 | Koboshi et al. | 428/36.6 |
| 4,814,260 | 3/1989 | Koboshi et al. | 430/393 |
| 4,816,384 | 3/1989 | Fruge et al. | 430/465 |
| 4,894,267 | 1/1990 | Bettle, III et al. | 428/36.6 |
| 4,923,786 | 5/1990 | Kühnert et al. | 430/465 |
| 4,960,639 | 10/1990 | Oda et al. | 428/34.7 |
| 5,098,819 | 3/1992 | Knapp | 430/483 |
| 5,100,765 | 3/1992 | Fujimoto | 430/484 |
| 5,132,149 | 7/1992 | Kotani et al. | 428/36.7 |
| 5,135,840 | 8/1992 | Reuter et al. | 430/461 |
| 5,165,988 | 11/1992 | Schaefer | 428/34.7 |
| 5,175,036 | 12/1992 | Smiley et al. | 428/36.7 |
| 5,194,306 | 3/1993 | Blarz | 428/36.7 |
| 5,196,298 | 3/1993 | Meeus et al. | 430/483 |
| 5,248,534 | 9/1993 | Rosen | 428/36.7 |

FOREIGN PATENT DOCUMENTS

| | | | |
|---|---|---|---|
| 0250219 | 12/1987 | European Pat. Off. . | |
| 0347222 | 12/1989 | European Pat. Off. . | |
| 0358035 | 3/1990 | European Pat. Off. | 430/465 |
| 0428101 | 5/1991 | European Pat. Off. . | |
| 3051122 | 3/1991 | Japan . | |
| 3176143 | 7/1991 | Japan | 428/34.7 |
| 3188443 | 8/1991 | Japan | 430/461 |
| 4179543 | 6/1992 | Japan | 428/34.7 |

OTHER PUBLICATIONS

Japanese Industrial Standard JIS Z 0208 (1976), "Testing Methods for Determination of the Water Vapour Transmission Rate of Moisture-Proof Packaging Materials (Dish Method)", edition 6, 8 pages, English translation.

Japanese Industrial Standard JIS Z 1707 (1975), "Plastic Films for Food Packaging", edition 1, 18 pages, English Translation.

Patent Abstracts of Japan vol. 14, No. 230 (P-1048)(4173) 16 May 1990 & JP-A-20 56 547 (Fuji) 26 Feb. 1990 * abstract *.

*Primary Examiner*—Charles L. Bowers, Jr.
*Assistant Examiner*—J. Pasterczyk
*Attorney, Agent, or Firm*—Frishauf, Holtz, Goodman & Woodward

[57] ABSTRACT

Disclosed is a photographic processing chemicals kit comprising a processing agent and a flexible container formed of multilayer film. The chemicals kit provide a photographic processing chemicals packaging material capable of protecting the photographic processing characteristics of its content against any storage conditions accompanied by a high temperature or vibration.

11 Claims, 4 Drawing Sheets

CHEMICALS KIT INCLUDING A CONTAINER FORMED OF MULTILAYER FILM, FOR PROCESSING PHOTOGRAPHIC LIGHT-SENSITIVE MATERIALS

FIELD OF THE INVENTION

The present invention relates to a kit containing chemicals for processing of photographic light-sensitive materials wherein the storage stability of the processing chemicals is improved by preventing the package materials used for containing the chemicals in the kit from degrading. More particularly the present invention relates to techniques to produce a kit containing photographic processing chemicals which, even when used after long storage can provide satisfactory photographic characteristics. Furthermore, the kit contains chemicals that are packaged in compact disposable packaging material having low combustion caloric output so that when they are incinerated for disposal, the heat output is low enough so as not to harm the environment.

The present invention also relates to the use of the processing kit for processing light-sensitive materials.

BACKGROUND OF THE INVENTION

A color photographic light-sensitive material for camera use, after being imagewise exposed, is usually subjected to processing steps comprising color developing, bleaching, fixing, washing and/or stabilizing; a color photographic paper, after being exposed in a printing process, is subjected to processing steps comprising color developing, bleach-fixing (bleaching, fixing), washing and/or stabilizing; and a black-and-white light-sensitive material, after being exposed, is usually subjected to developing, fixing and washing. Further, in the case of a reversal-type light-sensitive material, a reversal processing step is added to these processing steps.

The processing solutions used for these processing steps are commercially available in kit form containing concentrated solutions from the ease of transport and handling.

As the packaging material for these concentrated solutions there have conventionally been used plastic bottles, glass bottles and aluminum-sandwiched film containers. However, glass bottles can easily break during transit, allowing contents to run out. Plastic bottles are bulky and take up a large volume when discarded. Furthermore, plastic bottles, when incinerated, release sufficient energy to damage the incinerator. In addition, plastic bottle incineration creates a large amount of carbon dioxide, which is considered a cause of global warming. What is more important is that plastic bottles, when buried under the ground, do not decompose, resulting in problem that the reclaimed ground cannot be solidified. A film container made of aluminum (as a gas barrier) sandwiched by polyethylene resin sheets has also various shortcomings; for example, when subjected to incineration, the container is reduced to ashes, leaving the aluminum as an incinerated residuum, whose appropriate secondary treatment remains as a problem yet to be solved. Further, the ash causes the incinerator's filter to clog during incineration.

In addition, when the aluminum-sandwiched film container is used for the storage of low-pH concentrated kit solutions, its aluminum section tends to corrode or to cause delamination. These problems also occur when aluminum-sandwiched containers are, used for the storage of a strongly oxidizing bleacher such as ferric 1,3-propylenediaminetetraacetate.

Further, as packaging materials similar to that of the invention there have conventionally been known large packaging containers of 5-liter to 20-liter capacities such as those described in JP E.P. No. 14209/1929, Ekitight (trade name), produced by Dai Nippon Printing Co., Lontainer N (trade name), produced by Sekisui Seikei Kogyo Co., which can be used for photographic chemicals. These packaging materials consist of two or three outer and inner bags. It is difficult to produce such bags because their manufacture not only is costly with a heavy burden imposed thereon but also has the problem that their joined portions tend to become broken when subjected to vibrations. When a concentrated solution containing a bleaching agent or antioxidation agent is stored over a long period of time in these bags, the joined portions of the bags tend to deteriorate the quality of the content with time.

In recent years, as the number of small-scale photofinishers called 'minilabs' increased, the consumption of processing chemicals for small-sized automatic processors increased. This in turn has resulted in an increase in discarded chemicals packaging material which aggravates the problems of disposal.

Another problem occurs as a result of long time storage of processing chemicals which can occur at elevated temperatures exceeding 50° C. or under conditions wherein the packaged material is subjected to vibrations. These storage conditions can result in deterioration of the chemicals so that when they are used, they are unable is subjected to vibrations to provide objective photographic processing characteristics. In addition, the deteriorated processing chemicals, when used in an automatic processor, tend to form deposits on the inside walls of the processor. For this reason, there are demands for the development of a new packaging material capable of retaining the intrinsic characteristics of photographic processing chemicals contained therein, under severe conditions.

SUMMARY OF THE INVENTION

It is an object of the present invention to provide a photographic processing chemicals packaging material capable of protecting the photographic processing characteristics of its content against any storage conditions accompanied by a high temperature or vibration.

It is another object of the invention to provide a photographic processing chemicals packaging material which is environmentally sound for the reason that it is easily collapsible and disposable, emits as low a combustion calorie at the time of its incineration as not to damage the incinerator, and produces little carbon dioxide gas during incineration.

it is a further object of the invention to provide a processing chemicals packaging material in the form of a film container improved to be free from corrosion and delamination.

It is still another object of the invention to provide a processing chemicals packaging material improved to reduce the incidence of deposit on the inside walls of an autoprocessor.

It is a still further object of the invention to provide improvement of the preservability of the processing chemicals kit.

Other objects of the invention will become apparent from the following descriptions.

The above objects of the invention can be accomplished by any one of the following constructions (1) to (8):

(1) A photographic processing chemicals flexible packaging material comprised of at least one layer of a resin selected from among polyolefin resins and polyethylene-vinyl acetate copolymer resins, and at least one layer of a resin selected from the group consisting of:

A. ethylene-vinyl alcohol copolymer resin,
B. polyamide resin,
C. acrylonitrile resin,
D. polyethylene terephthalate resin,
E. polyhalogenated vinylidene resin and
F. polyhalogenated vinyl resin, and
G. the above-mentioned all resins each being deposited with ceramic.

(2) The photographic processing chemicals flexible packaging material of the above (1), wherein the packaging material has a water vapor transmission rate transmittance of not more than 20 g/m$^2$.day.

(3) The photographic processing chemicals flexible packaging material of the above (1) or (2), wherein the packaging material has an oxygen transmittance of not more than 5 ml/m$^2$.day.atm.

(4) The photographic processing chemicals flexible packaging material of the above (1) to (3), wherein the packaging material has a capacity of not more than 3 liters.

(5) The photographic processing chemicals flexible packaging material of any one of the above (1) to (4), wherein the packaging material comprises a multilayer film having at least a polyolefin resin layer and at least an ethylene-vinyl alcohol copolymer resin layer.

(6) The photographic processing chemicals flexible packaging material of any one of the above (1) to (4), wherein the packaging material comprises a multilayer film having at least a polyolefin resin layer and a ceramic layer.

(7) The photographic processing chemicals flexible packaging material of any one of the above (1) to (4), wherein the packaging material comprises a multi layer film having at least a polyethylene-vinyl acetate copolymer resin layer and a polyamide resin layer.

(8) The photographic processing chemicals flexible packaging material of the above (1) to (7), wherein the packaging material is of a standing pouch-type form.

Improvement on the preservability of the processing chemicals kit for the silver halide photographic light-sensitive material of the invention can be accomplished by the following constructions, along with the above photographic processing chemicals packaging material.

(1) Where the silver halide photographic light-sensitive material processing chemical is a bleacher, the bleacher contains at least one of those compounds represented by the following Formula B:

Formula B $$X_2—A—COOM^3$$

wherein $X_2$ represents a hydroxyl group, a halogen atom, an amino group or a —COOM$^3$ group; A is a saturated or unsaturated alkylene group when may have a substituent; and M$^3$ is a hydrogen atom, an ammonium group, an alkali metallic atom or an organic ammonium group. Further, the preferred embodiment of the invention is such that in the above silver halide photographic light-sensitive material processing kit and a processing method which uses the kit, the packaging material for the kit has a water vapor transmission rate of not more than 10 g/m$^2$.day, the packaging material is of a multilayer structure, and the processing kit contains a processing solution having a bleaching function.

(2) Where the silver halide photographic light-sensitive material processing chemical is a color developer replenisher, the replenisher contains at least one of those compounds represented by the following Formula 1:

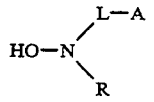

Formula 1 wherein L represents an alkylene group which may have a substituent; A is a carboxyl group, a sulfo group, a phosphono group, a phosphinic acid residue, a hydroxyl group, an amino group which may have an alkyl substituent, an ammonium group which may have an alkyl substituent, a carbamoyl group which may have an alkyl substituent, a sulfamoyl group which may have an alkyl substituent; and R represents a hydrogen atom or an alkyl group which may have a substituent.

(3) Where the silver halide photographic light-sensitive material processing chemical is a fixer, the ammonium ion inside the kit accounts for not more than 50 mol % of the whole cations in the kit.

Incidentally, the term 'kit' herein is synonymous with the kit used by those skilled in the art. For example, a kit for a color developing solution comprises a color developer part, a preservative part and an alkali agent part each in its own container. For preparation of a replenisher, the three parts are dissolved in a given amount of water, and to the solution is then added water to make the whole a prescribed amount (designated by a manufacturer). A set of these chemical parts is called a kit.

The 'flexible container' in the invention means a container which is formed with a film having a thickness of not more than 500 μm, preferably not more than 200 μm and which is easily collapsible when empty; for example, the container is composed of independent bottom and body parts joined and, when full, is able to stand alone, while, when empty, is easily collapsible,—the so-called standing pouch, unlike monoblock-molded plastic containers popularly used those in the art, having a wall thickness of 1000 μm or more and uncollapsible even when empty.

DETAILED DESCRIPTION OF THE INVENTION

Figure 1:
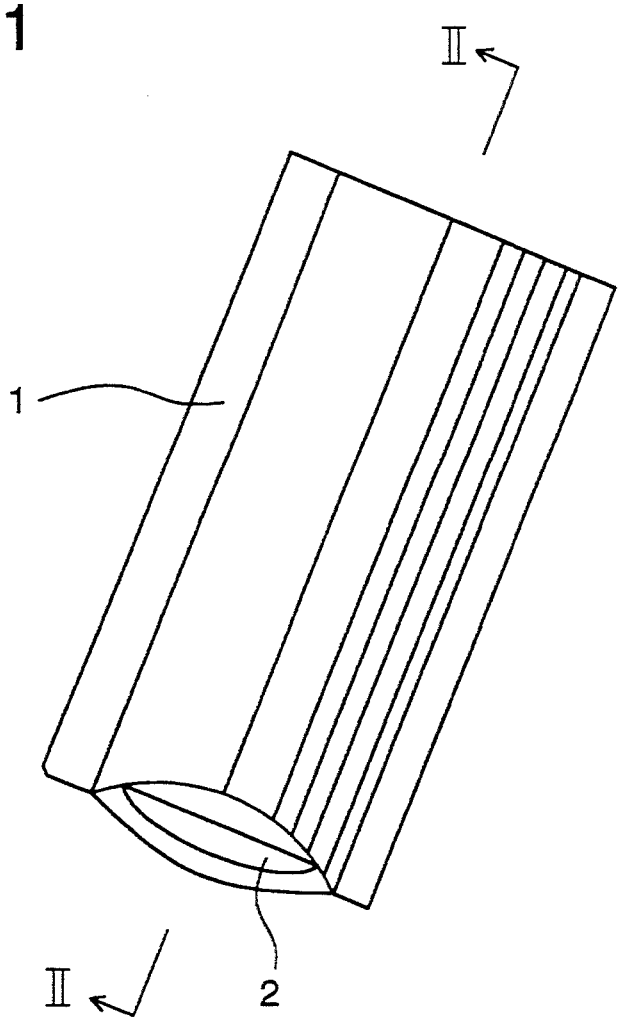
FIG. 1 is a schematic perspective illustration of an example of the silver halide photographic light-sensitive material processing chemicals packaging material of the invention

The resin used for the polyolefin resin layer is preferably a polyethylene, particularly LLDPE (linear low density polyethylene), from the moisture permeability and strength point of view, The thickness of the layer is preferably 30 to 500 μm, and more preferably 50 to 300 μm.

The preferably usable as the polyamide resin is nylon from the antipiercing strength and antipinhole characteristic point of view. The thickness of it is preferably 3 to 50 μm, and more preferably 5 to 30 μm.

Particularly, drawn nylon is preferable for the object of the invention. The aforementioned ceramic is an inorganic material composed principally of silicon oxide, which may be used under vacuum for coating a polyethylene or polyethylene terephthalate film. Particular examples of this include GL type ceramic-evaporated film, manufactured by Toppan Printing Co., Ltd.

As the ethylene-vinyl alcohol copolymer resin there are Kuraray Eval Films EF-XL, EF-F, EF-E, etc., manufactured by Kuraray Co., Ltd.

The halogen for the foregoing polyhalogenated vinylidene resin and polyhalogenated vinyl resin includes chlorine, fluorine and bromine. Examples of the resins include polyvinylidene chloride, polyvinyl chloride, polyvinylidene fluoride, polyvinyl fluoride, and the like.

In the invention, however, for the reason that emission of a harmful gas at the time of incineration is undesirable from the viewpoint of the protection of environment, out of the foregoing group of resins, the resins A to E are preferably used, and more preferably the resins A to C.

As the resin for the invention, there may be used any common one of those as described in the revised edition of the 'Plastic Film,' written by Gisaku Takahashi, published by Nikkan Kogyo Shimbun Dec. 20, 1976.

The water vapor transmission rate of the packaging material of the invention is preferably not more than 20 $g/m^2$.day, more preferably not more than 10 $g/m^2$.day, and most preferably not more than 5 $g/m^2$.day. While the correlation between the water vapor transmission rate of the packaging material and the change in quality of photographic processing chemicals has so far been unknown, it has been found that the effect of the invention can become significant by controlling the water vapor transmission rate to a specific value. Measurement of the water vapor transmission was made in the usual manner according to JIS Z 0208.

The oxygen transmittance of the packaging material of the invention is preferably not more than 10 $ml/m^2$.day.atm, more preferably not more than 5 $ml/m^2$.day.atm, and most preferably not more than 3 $ml/m^2$.day.atm. The oxygen transmittance was measured in the usual manner according to JIS Z 1707.

The thickness of the film as the packaging material of the invention is preferably 40 μm to 500 μm, and more preferably 100 μm to 300 μm from the viewpoint of the effect of the invention. The thickness, if less than 40 μm, lowers the film's gas barrier effect, while if more than 500 μm, increases the throwing amount into the discard in the dump to result in an increase in combustion heat in the incinerator.

The multilayer film in the invention is allowed to take various layer arrangements; from the side in contact with photographic processing chemicals layers may be arranged, for example, in various orders as described below:

(1) LLDPE/Ny(nylon)/PET(polyethylene terephthalate),
(2) LLDPE/Ny/EVOH(Eval)/Ny/ONy(orientated nylon),
(3) LLDPE/EVA(polyethylene-vinyl acetate copolymer)/Ny,
(4) LLDPE. S.PE (Sand polyethylene)/HDPE(high-density polyethylene,
(5) LLDPE/KON(vinylidene chloride-coated nylon),
(6) LLDPE/GLPET(ceramic-coated polyethylene terephthalate),
(7) PE(polyethylene)/EVOH/OPP(orientated polypropylene),
(8) LDPE(low-density polyethylene),
(9) LDPE/EVOH/ONy,
(10) PE/KPE(vinylidene chloride polyester),
(11) PE/Ny,
(12) PE/EVOH/Ny,
(13) PE/EVOH/KPE,
(14) PE/EVOH/KPET(vinylidene chloride-coated PET),
(15) LDPE/EVOH/KPET,
(16) EVA(polyethylene-vinyl acetate copolymer)/Ny,
(17) EVA/ONy,
(18) EVA/EVOH/ONy,
(19) LDPE/AN(Acrylonitrile)/Ny,
(20) LLDPE/S.PE/LLDPE/Ny/EVOH/-Ny/ONyo
(21) LLDPE/S.PE/HDPE/S.PE/LLDPE/-Ny/EVOH/Ny/PET,
(22) LLDPE/S.PE/LLDPE/Ny/EVOH/Ny/ONy, and
(23) LLDPE/S.PE/LLDPE/Ny/EVOH/Ny/PET.

Production of the multilayer film may be carried out with no restrictions in various methods such as of film-to-film sticking together with an adhesive, film-to-film sticking together with a molten resin, laminating two or more different resins extruded from slits or other prevalent film laminating methods. These methods may be used alone or in combination.

Figure 2:
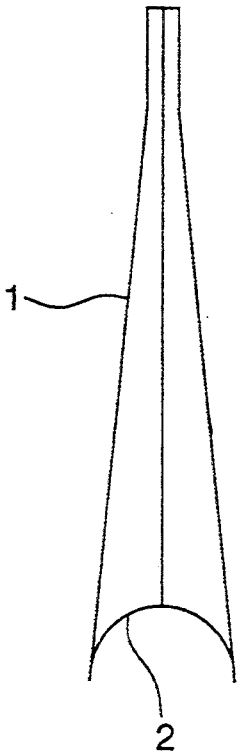
FIG. 2 is a cross-sectional view as seen in the direction of arrows from the line of II—II of FIG. 1.
Figure 2A:
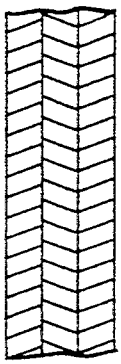
FIG. 2A is a cross-sectional view of the multi-layer packaging material.

The silver halide photographic light-sensitive material processing chemicals packaging material of the invention is preferably in the standing pouch form, an example of which is shown in FIGS. 1 and 2. The packaging material is composed of a multilayer film (see FIG. 2A), the number of laminated layers of which is not limited.

In the figures, 1 is the pouch body, and 2 is its bottom. Each section is made of a multilayer film.

The capacity of the pouch is preferably not more than 3 liters, and more preferably not more than 2 liters for ease of handling. It is preferable for the pouch to be provided with a catch or stopper in order to make it easier to handle.

Figure 3:
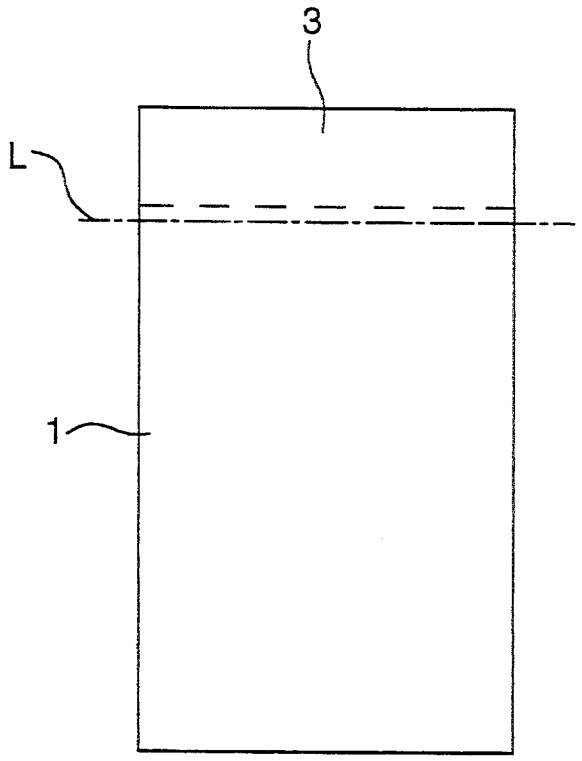
FIG. 3 is a drawing showing the heat-sealed section and the cutting line of a preferred processing chemicals packaging material of the invention.
Figure 4:
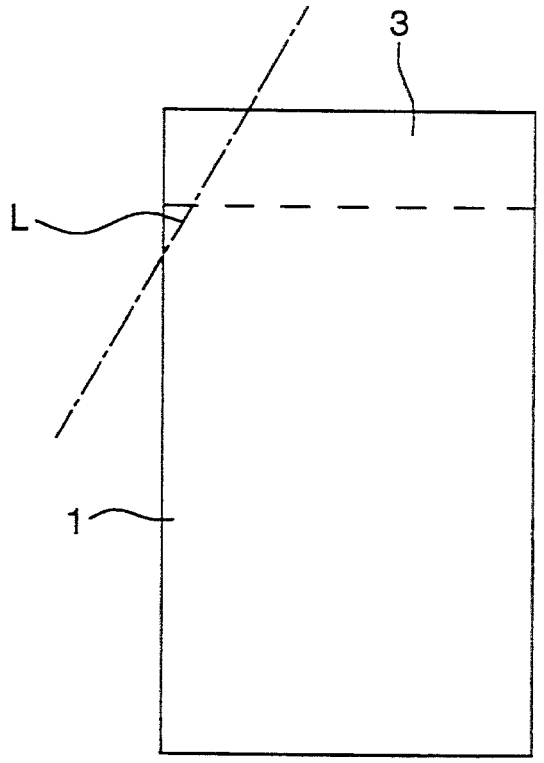
FIG. 4 is a drawing showing the heat-sealed section and the cutting line of another preferred processing chemicals packaging material of the invention.

The processing chemicals packaging material of the invention may be formed by, e.g., heat sealing the side and the upper part of body 1 and in the lower part also heat sealing body 1 and bottom 1, but for the heating sealing section in the upper part there are various embodiments as shown in FIGS. 3 and 4, wherein 3 is a heat sealing section, L is a cutting line. By doing this, various embodiments can be obtained at the take-out opening for the processing solution.

The packaging material of the invention can be used as containers for photographic processing chemicals including those for use in processing all silver halide photographic light-sensitive materials such as color films, color photographic papers, reversal films, black-and-white films for general use, X-ray films, lith films for graphic arts use, and micrographic films.

The photographic processing chemicals used in the invention are described below.

The photographic processing chemicals include a developer, bleacher, fixer, bleach-fixer, stabilizer, neutralizer, black-and-white developer, conditioner, stop-fixers, and short stop.

Where the processing chemicals kit used in the invention is a bleacher kit or a bleach-fix kit, the kit is characterized by having at least a compound represented by the foregoing Formula B.

Acetic acid is conventionally used as an essential constituent of the bleaching or bleach-fix solution for use in processing color photographic light-sensitive materials or of the fixing solution for black-and-white films for general use, X-ray films and lith films for graphic arts use. The use an acetic acid-free bleaching or bleach-fix solution in processing color photographic light-sensitive materials causes bleaching fog or silver retention, thus adversely affecting photographic characteristics. The acetic acid contained in the fixing solution in processing black-and-white films for general use or X-ray films is indispensable to hardening such films.

The light-sensitive materials processing chemicals kit can be divided into some parts, acetic acid in one part of which is more concentrated than the other chemicals parts. Accordingly, the influence by the acid upon its packaging material is significant.

In order to reduce the degradation of the packaging material to improve the preservability of processing solutions to thereby improve photographic characteristics, we, the inventors, have made our continued investigations. As a result, to our surprise it has now been found that the filling of a processing solution containing at least one of those compounds represented by Formula B in a kit packaging material prevents the packaging material from degradation.

The compound of Formula B is explained.

In Formula B, $X_2$ represents a hydroxyl group, a halogen atom, an amino group or a —$COOM^3$; A represents a saturated or unsaturated alkylene group which may have a substituent, wherein $M^3$ is a hydrogen atom, an ammonium group, an alkali metallic atom or an organic ammonium group such as triethanolammonium.

In the invention, a processing solution containing at least one compound represented by the foregoing Formula B is filled in a flexible packaging material having an oxygen transmittance of preferably not more than 5.0 cc/24 hrs.atm, more preferably 2.0 cc/24 hrs.atm, and most preferably 1.0 cc/24 hrs.atm under conditions of 30° C./70%RH, wherein the oxygen transmittance is measured with an oxygen transmittance tester, manufactured by Oxtrancommon Corp.

The following are useful examples of the compound represented by Formula B.

Exemplified Compounds:

$HOOCCH_2C(OH)(COOH)CH_2COOH$ (B-1)
$HOOC(CHOH)_2COOH$ (B-2)
$HOOCCH_2COOH$ (B-3)
$HOOCCH(OH)CH_2COOH$ (B-4)
$HOOCCH{=}CHCOOH$ (B-5)

-continued

Exemplified Compounds:

$HOOCCH_2CH_2COOH$ (B-6)
$HOOC{-}(CH_2)_4{-}COOH$ (B-7)

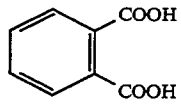
(B-8)

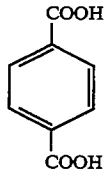
(B-9)

$NaOOCCH{=}CHCOONa$ (B-10)
$KOOCCH{=}CHCOOK$ (B-11)
$H_4NOOCCH{=}CHCOONH_4$ (B-12)

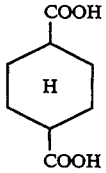
(B-13)

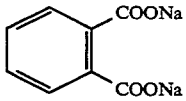
(B-14)

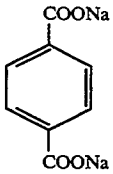
(B-15)

$HOOC{-}(CH_2)_3{-}COOH$ (B-16)

$H_2C{=}C(H_2C{-}COOH){-}COOH$ (B-17)

$H_3C{-}C({=}CH{-}COOH){-}COOH$ (B-18)

$HOOCCH_2CH(CH_3)COOH$ (B-19)
$HOCH_2COOH$ (B-20)
$ClCH_2COOH$ (B-21)
$NH_2CH_2COOH$ (B-22)

The preferred among the above exemplified compounds are the aliphatic dicarboxylic acids B-2 to B-7, B-10 to B-12 and B-16 to B-19, and the most preferred are B-5, B-6 and B-16.

The added amount of the compound of Formula B is preferably 0.05 to 2.0 mols, more preferably 0.2 to 1.0 mol per liter of a bleaching or bleach-fix solution, [0039] while in the case of a concentrated solution thereof, preferably 0.2 to 4.0 mols, and most preferably 0.4 to 2.5 mols per liter.

Subsequently, the bleaching solution and bleach-fix solution are explained. The bleaching agent to be used in the bleaching or bleach-fix solution is not restricted, but is preferably a ferric complex salt of an organic acid represented by the following Formula A or B or a ferric complex salt of diethylenetriaminepentaacetic acid.

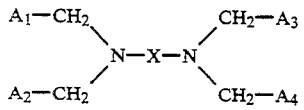

Formula A wherein $A_1$ to $A_4$ may be either the same as or different from one another and each represent $—CH_2OH$, —COOM or $—PO_3M_2M_2$, wherein M, $M_1$ and $M_2$ each represent a hydrogen atom, a sodium atom, a potassium atom or an ammonium group; and X is a substituted or unsubstituted alkylene group having 2 to 6 carbon atoms.

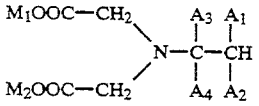

Formula B wherein $A_1$, $A_2$, $A_3$ and $A_4$ may be either the same as or different from one another and each represent a hydrogen atom, a hydroxyl group, —COOM, $—PO_3M_2$, $—CH_2OH$ or a lower alkyl group (methyl, isopropyl, n-propyl, etc.), provided at least one of $A_1$, $A_2$, $A_3$ and $A_4$ is —COOM or $—PO_3M_2$; and [0045] M, $M_1$ and $M_2$ each represent a hydrogen atom, an ammonium group, a sodium atom, a potassium atom, a lithium atom or an organic ammonium group (e.g., trimethyl ammonium, triethanol ammonium, etc.).

The following are preferred examples of the compound represented by Formulas A and B:

Exemplified Compounds:

(A-1)

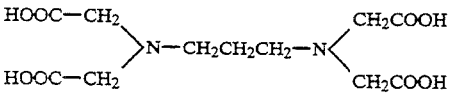

(A-2)

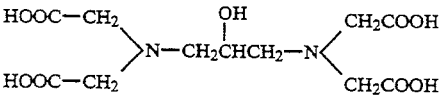

(A-3)

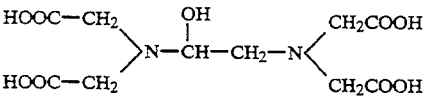

(A-4)

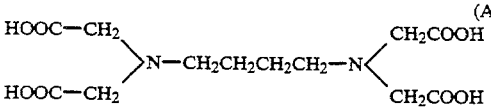

(A-5)

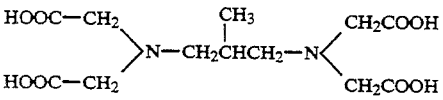

(A-6)

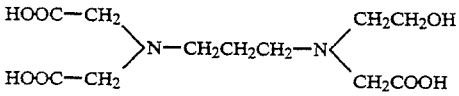

-continued

Exemplified Compounds:

(A-7)

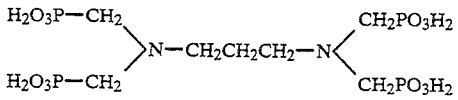

(A-8)

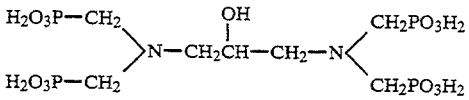

(A-9)

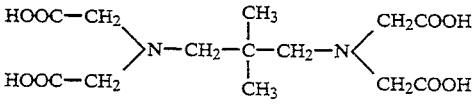

(A-10)

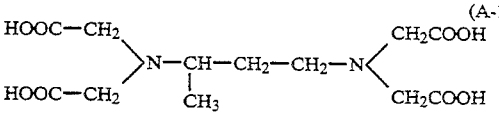

(A-11)

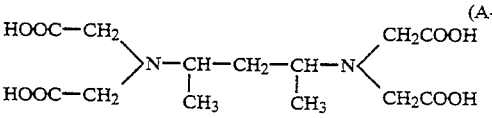

(A-12)

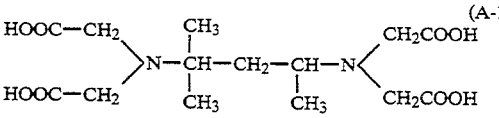

(A-13)

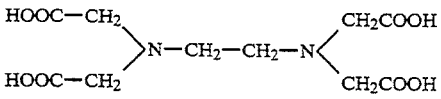

(B-1)

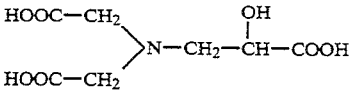

(B-2)

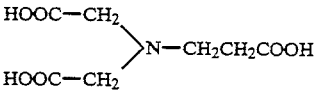

(B-3)

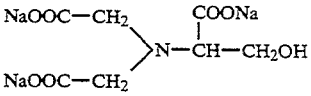

(B-4)

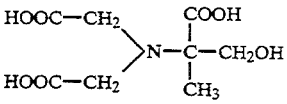

(B-5)

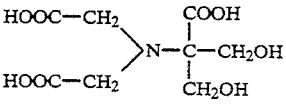

(B-6)

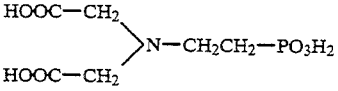

-continued

Exemplified Compounds:

(B-7)

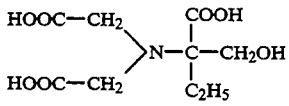

(B-8)

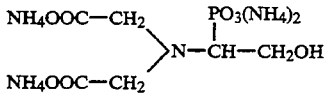

(B-9)

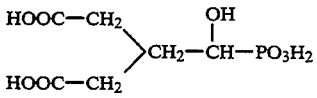

(B-10)

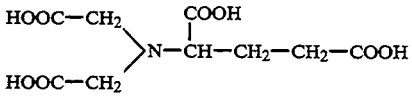

In addition to these compounds A-1 through A-13, sodium salts, potassium salts or ammonium salts of them may be suitably used as well.

From the viewpoint of the effect of the invention as well as the solubility, ferric-ammonium salts of the above compounds may be preferably used.

In the invention, the preferably usable among the above compounds are A-1, A-4, A-7, A-9 and A-13, and most preferably A-1 and A-9.

The concentration of the organic acid ferric complex salt contained in the processing chemicals concentrated solution composition according to the invention is preferably not less than 0.3 mol, more preferably 0.35 to 2 mols and most preferably 0.4 to 1 mol per liter of the composition.

The bleaching solution kit or bleach-fix solution kit of the invention may have both the above organic ferric complex salt and a compound of Formula B contained in one and the same part of the kit.

The bleaching solution or bleach-fix solution of the invention is used at a temperature of preferably and more preferably 25° C. to 45° C.

The bleaching solution or bleach-fix solution of the invention has a pH of preferably not more than 5.0, and more preferably 2.0 to 4.7. Generally speaking, as pH becomes lowered, the bleaching power increases, but it causes a leuco dye problem to tend to occur. The problem, however, can be solved by combining the pH control with the use of the invention's compound and an organic ferric complex salt, particularly, ferric complex salts of organic acids represented by Formulas A and B.

The pH of the bleaching solution and/or bleach-fix solution of the invention is the pH of the processing bath used when processing a silver halide light-sensitive material, and is clearly distinguished from the pH of the so-called replenisher.

A silver halide such as ammonium bromide is normally added to the bleaching solution and bleach-fix solution of the invention. The bleaching solution and bleach-fix solution may also contain a brightening agent, defoaming agent or surfactant.

The preferred amount of the replenishisher to the bleaching solution is 20 to 500 ml, preferably 30 to 350 ml, more preferably 40 to 300 ml, and most preferably 50 to 250 ml $m^2$ of a silver halide color photographic light-sensitive material. The smaller the replenishing amount, the more conspicuous the effect of the invention becomes.

The processing chemicals kit form is usually comprised a fixer part and a bleaching solution part, but may be partitioned into more parts.

The compound of Formula B of the invention preferably either is put in the bleaching solution's part or forms an independent part of its own.

In the invention, in order to highly activate the bleaching solution or bleach-fix solution, air or oxygen may, if necessary, be blown into its bath or its replenisher tank, or else an appropriate oxidizing agent such as hydrogen peroxide, a bromate or a persulfate may be discretionally added thereto.

In the invention, even if the accumulated silver and iodide amounts increase in the fixing solution (e.g., up to $Ag^+$6 g or more/liter, up to $I^-$0.6 g or more/liter), the objects of the invention can be accomplished without deteriorating the bleachability.

The bleach-fix solution of the invention, when its replenishing amount is not more than 1200 ml per $m^2$ of a light-sensitive material, well exhibits the effect of the invention. The replenishing amount is preferably 20 ml to 1000 ml and more preferably 500 ml to 800 ml per $m^2$ of a light-sensitive material.

The total processing time of the bleaching solution and bleach-fix solution of the invention is preferably not longer than 3 minutes and 45 seconds, more preferably 20 seconds to 3 minutes and 20 seconds, still more preferably 40 seconds to 3 minutes, and most preferably 60 seconds to 2 minutes and 40 seconds.

The bleaching time may be discretionarily selected within the above total time limits, but is preferably not longer than 1 minute and 30 seconds, particularly 10 seconds to 70 seconds and most preferably 20 seconds to 55 seconds.

The bleach-fix solution's processing time may be arbitrarily selected within the above total time range, but is preferably not more than 3 minutes and 10 seconds, more preferably 10 seconds to 2 minutes and 40 seconds, and most preferably 20 seconds to 2 minutes and 10 seconds.

In the processing method of the invention, it is preferable as an embodiment of the invention to apply a forced stirring to the bleaching solution and bleach-fix solution because the use of a forced stirring is suitable not only for raising the effect of the invention but also for rapid processing. The forced stirring herein is not the usual diffusion transfer of a liquid but implies that a liquid is forcibly stirred by the application of a stirring means.

As the forcibly stirring means there may be used the means described in Japanese Patent Application No. 48930/1988.

Suitable examples of the procedure steps in the processing method of the invention are given below:

(1) Color developing→bleaching→fixing→washing, (2) Color developing→bleaching→fixing→washing→stabilizing, (3) Color developing→bleaching→fixing→stabilizing, (4) Color developing→bleaching→fixing→1st stabilizing→2nd stabilizing, (5) Color developing→bleaching→bleach-fix→washing, (6) Color developing→bleaching→bleach-fix→washing→stabilizing, (7) Color developing→bleaching→bleach-fix→stabilizing, (8) Color developing→bleaching→bleach-fix→1st stabilizing→2nd stabilizing, (9) Color developing→bleach-fix→fixing→stabilizing,

(10) Color developing→bleach-fix→washing,

(11) Color developing→bleach-fix→stabilizing.

The preferred among the above processing procedures listed in above are (3), (4), (7) and (8), and the more preferred are (3) and (4).

Where the processing kit used in the invention is a color developer replenisher kit, it is characterized by containing at least one compound represented by Formula 1.

The compound of Formula 1 is explained.

In Formula 1, L represents a straight-chain or branched-chain substitutable alkylene group having preferably carbon atoms and more preferably 1 to 5 carbon atoms, such as methylene, ethylene, trimethylene and propylene, wherein the substituent includes carboxy, sulfo, phosphono, phosphinic acid residue, hydroxy and alkyl-substitutable ammonia groups, the preferred ones out of which groups are the carboxy, sulfo, phosphono and hydroxy groups. A represents a carboxy group, a sulfo group, a phosphono group, a phosphinic acid residue, a hydroxy group, an alkyl-substitutable amino group, an (having preferably 1 to 5 carbon atoms)-substitutable ammonium group, an alkyl (having preferably 1 to 5 carbon atoms)-substitutable carbamoyl group, an alkyl (having preferably 1 to 5 carbon atoms)-substitutable sulfamoyl group, a carboxy group, a sulfo group, a hydroxy group, a phosphono group or an alkyl-substitutable carbamoyl group. Useful examples of the -L-A includes carboxymethyl, carboxyethyl, carboxypropyl, sulfoethyl, sulfopropyl, sulfobutyl, phosphonomethyl, phosphonoethyl and hydroxyethyl groups, the most preferred ones out of which groups are the carboxymethyl, carboxyethyl, sulfoethyl, sulfopropyl, phosphonomethyl and phosphonoethyl group. R represents a hydrogen atom or a straight-chain or branched-chain substitutable alkyl group having 1 to 10 carbon atoms, particularly 1 to 5 carbon atoms, wherein the substituent includes carboxy, sulfo, phosphono, sulfinic acid residue, hydroxy, alkyl-substitutable amino, alkyl-substitutable ammonium, alkyl-substitutable carbamoyl, alkyl-substitutable sulfamoyl, substitutable alkylsulfonyl, acylamino, alkylsulfonyl, acylamino, alkylsulfonylamino, arylsulfonylamino, alkoxycarbonyl, alkyl-substitutable amino, arylsulfonyl, nitro, and cyano groups and halogen atoms. R may have two or more of the above substituents. Useful examples of R include a hydrogen atom and methyl, ethyl, propyl, carboxymethyl, carboxyethyl, carboxypropyl, sulfoethyl, sulfopropyl, sulfobutyl, phosphonomethyl, phosphonoethyl and hydroxyethyl groups. Out of these groups the most preferred are the hydrogen atom, carboxymethyl, carboxyethyl, sulfoethyl, sulfopropyl, phosphonomethyl and phosphonoethyl group. L and R may link to form a ring.

The following are typical examples of the compound represented by Formula 1.

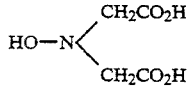
(1)

-continued

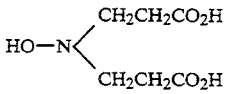
(2)

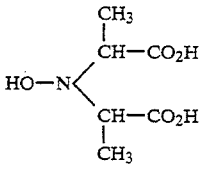
(3)

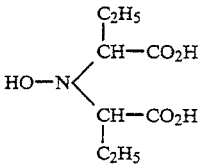
(4)

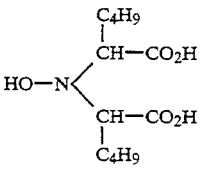
(5)

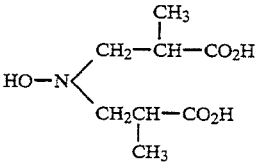
(6)

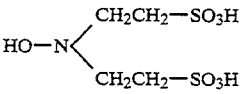
(7)

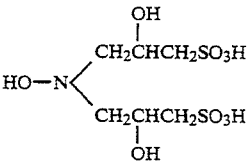
(8)

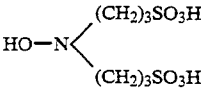
(9)

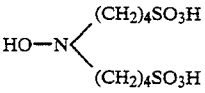
(10)

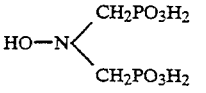
(11)

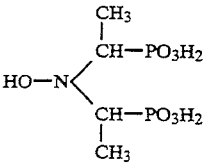
(12)

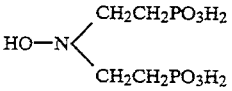
(13)

-continued
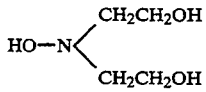
(14)
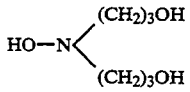
(15)
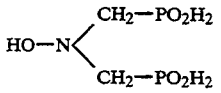
(16)
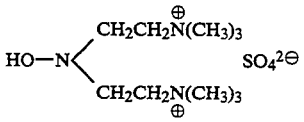
(17)
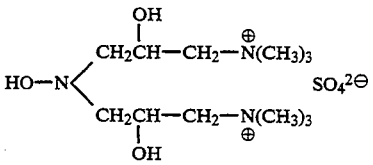
(18)
(19)
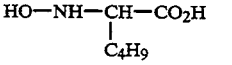
(20)
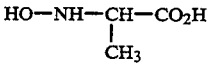
(21)
(22)
(23)
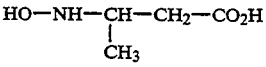
(24)
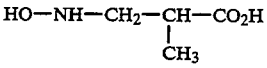
(25)
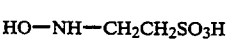
(26)
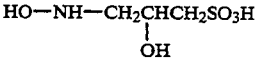
(27)
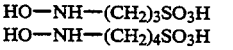
(28)
(29)
(30)
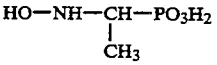
(31)
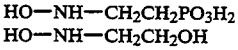
(32)
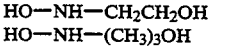
(33)
(34)
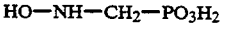
(35)
(36)
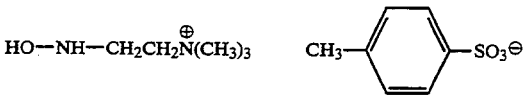
-continued
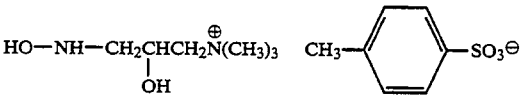
(37)
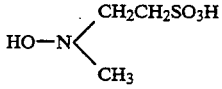
(38)
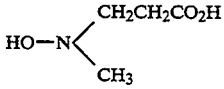
(39)
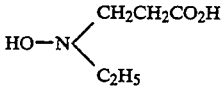
(40)
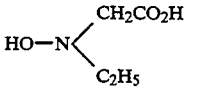
(41)
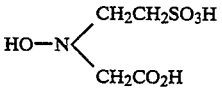
(42)
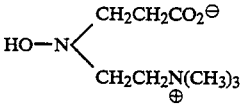
(43)
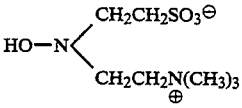
(44)
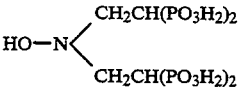
(45)
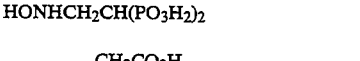
(46)
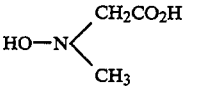
(47)
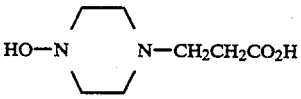
(48)
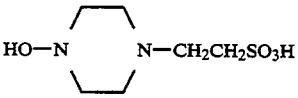
(49)
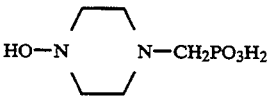
(50)
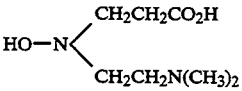
(51)

-continued

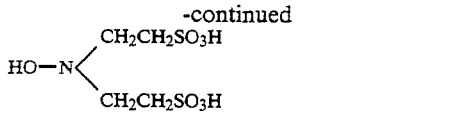

(52)

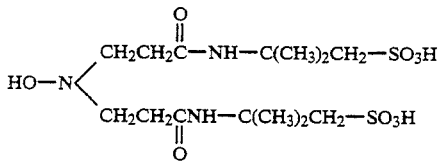

(53)

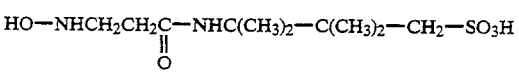

(54)

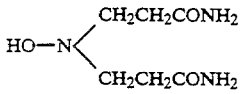

(55)

The preferred among the above listed compounds are (2), (7), (14), (38), (39), (40) and (55).

The compound of Formula 1 can be synthesized by the alkylation reaction (nucleophilic substitution reaction, addition reaction, Mannich reaction) of a commercially available hydroxylamine product. The synthesis may be carried out by making reference to the synthesis methods described in West German Patent No. 1,159,634 and the Inorganica Chemica Acta, 93, (1984) 101–108.

Some of the above compounds of Formula 1 are described in JP O.P.I. No. 264751/1988, so that they are known as preservatives for a color developer solution. However, the object of the invention is to improve the durability of a flexible packaging material filled with a processing solution containing a preservative as well as to improve the processing solution's stability against change in concentration of the preservative, and the above publication makes no mention of these points at all. A large improvement on the durability of the flexible container in the case of using the compound of Formula 1 is a brand-new technique, showing a surprising effect.

In the invention, where a color developer is provided in a product form of kit chemicals, the kit is preferably available in a pack partitioned into 2 to 4 parts. A kit of five or more parts is undesirable because it makes its preparation work complicated, increasing the possibility of misdisolving.

In the invention, (1) a color developing agent and (2) an alkali agent-containing high pH solution are desirable to be packed in separate parts. In this instance, the compound of Formula 1 may be contained in either (1) or (2), but is more preferably contained in another, a third part.

The third part, containing the compound of Formula 1, may additionally contain a glycol compound such as ethylene glycol, diethylene glycol or polyethylene glycol; an alkanolamine such as diethanolamine or triethanolamine; a chelating agent such as ethylenediaminetetraacetic acid, diethylenetriaminepentaacetic acid or 1-hydroxyethylidene-1,1-diphosphonic acid; an aromatic carboxylic acid such as paratoluenesulfonic acid; an alkali halide, a surfactant, a brightening agent, and the like.

The color developing agent used in the color developer of the invention is preferably a p-phenylenediamine compound having a hydrophilic group. This compound is suitably used since it satisfactorily effectuates the object of the invention and produces little fog in processing.

The p-phenylenediamine compound having a hydrophilic group has the advantage that it less stains a light-sensitive material in processing and, when contacting to the skin, develops less skin rash than does a hydrophilic group-free p-phenylenediamine compound such as N,N-diethyl-p-phenylenediamine.

Regarding the foregoing hydrophilic group, there are p-phenylenediamine compounds having at least one hydrophilic group on the amino group thereof or on the benzene ring thereof. Particular examples of the hydrophilic group include:

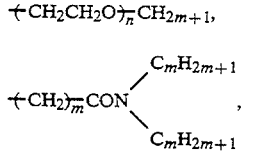

wherein m and n each are an integer of zero, 1 or more; —COOH and —$SO_3H$.

Suitably usable examples of the color developing agent in the invention include Compounds C-1 to C-16 described in Japanese Patent Application No. 203169/1990, pp.26–31; Compounds 1 to 8 described in JP O.P.I. No. 289350/1986, pp.29–31; and Compounds 1 to 62 described in JP O.P.I. No. 246543/1990, pp.5–9. Of these compounds the most preferred are the Compounds C-1 and C-3 in Japanese Patent Application No. 203169/1990, the Compound 2 in JP O.P.I. No. 289350/1986 and the Compound 1 in JP O.P.I. No. 246543/1991.

The above color developing agent is used usually in the form of a salt such as a hydrochloride, sulfate or p-toluenesulfonate.

The amount of the color developing agent to be used is preferably not less than $0.5\times10^{-2}$ mol, more preferably $1.0\times10^{-2}$ to $1.0\times10^{-1}$ mol, and most preferably $1.5\times10^{-2}$ to $1.0\times10^{-1}$ mol per liter of a color developer solution.

The compound represented by Formula 1 is contained in a concentration of preferably $1.5\times10^{-3}$ to $1.5\times10^{-1}$ mol, and more preferably $5.0\times10^{-3}$ to $1.0\times10^{-1}$ mol per liter of a color developer tank solution. As a preservative a sulfate may be used in combination with the compound.

A development accelerator may, if necessary, be added to the color developer solution. Examples of the development accelerator include the thioether compounds described in JP E. P. Nos. 16088/1962, 5987/1962, 7826/1963, 12380/1969 and 9019/1970, and U.S. Pat. No. 3,813,247; the p-phenylenediamine compounds described 49829/1977 and in JP O.P.I. Nos. 15554/1975; the quaternary ammonium salts described in JP O.P.I. No. 137726/1975, JP E.P. No. 30074/1969, JP O.P.I. Nos. 156826/1981 and 43429/1977; the p-aminophenols described U.S. Pat. Nos. 2,610,122 and 4,119,462; the amine compounds described in U.S. Pat. Nos. 2,494,903, 3,128,182, 4,230,796, 3,253,919, 2,482,546, 2,596,926 and 3,582,346, and JP E.P. No.

11431/1966; the polyalkylene oxides described in JP E.P. Nos. 16088/1962, 11431/1966, 23883/1967 and 25201/1967, and U.S. Pat. Nos. 3,128,183 and 3,532,501; and further, 1-phenyl-3-pyrazolidones, hydrazines, mesoionic-type compounds, ionic-type compounds and imidazoles.

The color developer solution is preferably one substantially not containing benzyl alcohol, wherein the '. . . substantially not containing . . .' means that the color developer tank solution contains benzyl alcohol in preferably 2.0 ml or less/liter, and more preferably contains no benzyl alcohol at all. The color developer solution, when substantially not containing benzyl alcohol, less changes photographic characteristics and less increases stain in running processing than when containing, and further causes no delamination of the film container, thus providing better results.

It is preferable for the color developer tank solution to contain chlorine and bromine ions for the antifogging purpose. The chlorine ion content is preferably $1.0\times10^{-2}$ to $1.5\times10^{-1}$ mol/litter, and more preferably $4\times10^{-2}$ to $1\times10^{-1}$ mol/liter. The chlorine ion concentration, when higher than $15\times10^{-5}$ mol/liter, retards the developing rate, so that it is undesirable for obtaining the maximum density rapidly, while when lower than $1.0\times10^{-2}$ mol/liter, produces stain and further increases the variation of photographic characteristics (particularly the minimum density) due to running processing.

The bromide ion concentration is preferably $3.0\times10^{-5}$ to $1\times10^{-}$'mol/liter, and more preferably $5.0\times10^{-5}$ to $5.0\times10^{-4}$ mol/liter. The bromine ion concentration, when not less than $1\times10^{-3}$ mol/liter, retards the developing rate and lowers the maximum density and sensitivity, while when lower than $3.0\times10^{-5}$ mol/liter, produces stain and increases the variation of photographic characteristics (particularly the minimum density) due to running processing.

The color developer solution used in the invention may, if necessary, contain chlorine and bromine ions by adding an arbitrary antifoggant thereto. As the antifoggant there may be used an alkali metal halide, such as potassium iodide, and organic antifogging agents. Examples of the organic antifogging agent include nitrogen-containing heterocyclic compounds such as benzotriazole, 6-nitrobenzimidazole, 5-nitroisoindazole, 5-methylbenzotriazole, 5-nitrobenzotriazole, 2-chlorobenzotriazole, 2-thiazolyl-benzimidazole, 2-thiazolylmethyibenzimidazole, indazole, hydroxyazaindolidine, adenine and 6-benzyladenine.

Incorporation of a triazinylstilbene brightening agent into the color developer solution of the invention is preferable from the effect of the invention point of view.

Suitable as the brightening agent are triazinylstilbene compounds, especially those represented by the following Formula 2:

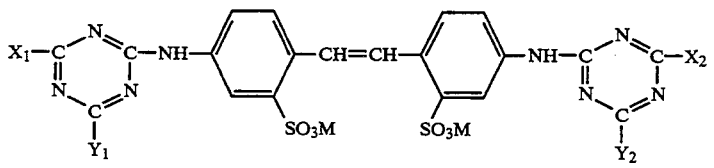

Formula 2

Formula 2 is as defined for the Formula E described in Japanese Patent Application No. 178833/1990, pp.73–75.

Exemplified Compounds 2-1 to 2-45 for Formula 2 are the same as those of E-1 to E-45 shown in Japanese Patent Application No. 178833/1990, pp.76–82.

The triazinylstilbene brightening agent is commercially available, but can be synthesized in the usual manner as described in the 'Keikozohakuzai,' ('Brightening Agents') compiled by Kaseihin Kogyo Kai (Chemical Industries Association) (published in Aug. 1976).

Among the exemplified compounds those most suitably usable are 2-4, 2-24, 2-34, 2-35, 2-36, 2-37 and 2-41.

The triazinylstilbene brightening agent content of the color developer tank solution is preferably in the range of 0.2 to 10 g, and more preferably 0.4 to 5 g per liter thereof.

In addition, various other additives may be used such as antistain agents, antisludge agents, intereffect acceleration agents, and the like.

Further, the incorporation into the color developer solution of any one of those chelating agents represented by the following Formula K and its exemplifed Compounds K-1 to K-22 which are described in Japanese Patent Publication No. 240400/1990 is preferred from the viewpoint of effectuating the object of the invention.

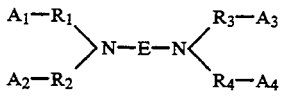

Formula K

The preferred among these chelating agents are K-2, K-9, K-12, K-13, K-17 and K-19, and especially the addition of K-2 and K-9 satisfactorily exhibits the effect of the invention.

The adding amount of the chelating agent is preferably 0.1 to 20 g, and more preferably 0.2 to 8 g per liter of the color developer tank solution.

In the invention, the above color developer solution may be used at an arbitrary pH value, but is used preferably at pH 9.5 to 13.0, and more preferably pH 9.8 to 12.0 from the rapid processing point of view. The processing temperature of the color developer solution is normally not less than 30° C., preferably not less than 33° C., and most preferably 35° to 65° C. The processing time is preferably within 90 seconds, more preferably not less than 3 seconds and less than 60 seconds, and most preferably 3 seconds to 45 seconds.

In the processing method of the invention, the processing steps and solutions other than the processing using the above color developer solution employ known processing steps and solutions.

As the fixing agent used in the fixer kit of the invention a thiosulfate or a thiocyanate is used. The thiocyanate content of the fixer solution is preferably at least not less than 0.1 mol/liter, and when processing color negative film, more preferably not less than 0.5 mol/-liter, and most preferably not less than 1.0 mol/liter. The thiosulfate content of the fixer solution is preferably at least not less than 0.2 mol/liter, and when processing color negative film, more preferably not less than 0.5 mol/liter. The object of the invention can be more effectively accomplished by using a thiosulfate in combination with a thiocyanate.

The photographic processing kit having a fixability in the invention may contain one or two or more kinds of pH buffer comprising various salts in addition to the above fixing agents. Further, it is preferable for the kit to contain a large amount of an alkali halide or ammonium halide as a rehalogenating agent, such as potassium bromide, sodium bromide, sodium chloride, ammonium bromide, etc. Further, those additives known to be usually added to a fixing or bleaching bath, such as alkylamines, polyethylene oxides, and the like, may also be arbitrarily added to the kit.

In the invention, the ammonium cation's proportion to the total cations in the thiosulfate-containing fixer solution was varied.

The ammonium cation concentration proportion to the whole cations in the fixer is preferably 50 to 0 mol %, more preferably 20 to 0 mol %, and most preferably 10 to 0 mol %.

To the photographic processing kit having fixability of the invention is preferably added any one of those compounds represented by the Formula FA and its exemplified Compounds FA-1 to FA-39 or of those compounds of the Formula FB described in Japanese Patent Application No. 206120/1990. The addition of it can better exhibit the effect of the invention and can also provide a supplemental effect that it produces little or no sludge in a fixability-having processing solution used for processing small quantities of light-sensitive materials over an extensive period.

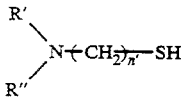

Formula FA wherein R' and R'' each represent a hydrogen atom, an alkyl group, an aryl group, an aralkyl group or a nitrogen-containing heterocyclic group; and n is an integer of 2 or 3.

The following are preferred ones out of the aforementioned exemplified Compounds FA-1 to FA-39.

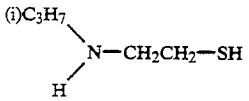

FA-1

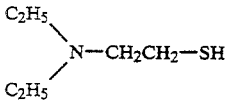

FA-12

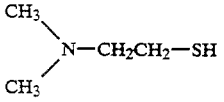

FA-21

-continued

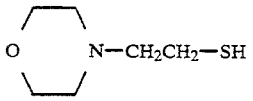

FA-32

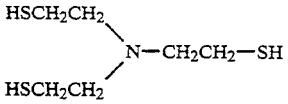

FA-38

These compounds of Formula FA can be synthesized in accordance with those prevalent methods as described in U.S. Pat. Nos. 3,335,161 and 3,260,718.

The group of Compounds FB are as follows:

FB-1: Thiourea

FB-2: Thiocyano catechol

The above compounds represented by Formula FA and the group of Compounds FB may be used alone or in combination of two or more kinds thereof; for example, FB-1 and FA-21, FB-1 and FA-12, FA-12 and FA-38, FA-12 and FA-32, FA-12 and FA-21. The most preferred is FB-1.

The adding amount of these compounds of Formula FA and the group of Compounds FB is in the range of preferably 0.1 to 300 g, more preferably 0.2 to 200 g and most preferably 0.5 to 150 g per liter of the processing solution.

Subsequently, the stabilizer is explained. The stabilizer contains preferably a chelating agent whose chelate stability constant to ferric ions is not less than 8, wherein the chelate stability constant implies the constant generally known by L. G. Sillen and A. E. Martell, the 'Stability Constants of Metalion Complexes,' The Chemical Society, London (1964), and S. Chaberek and A. E. Martell, the 'Organic Sequestering Agents,' Wiley (1959).

Examples of the chelating agent whose chelate stability constant to ferric ions is not less than 8 include those as described in Japanese Patent Application Nos. 234776/1990 and 324507/1989.

The using amount of the above chelating agent is preferably 0.01 to 50 g, and more preferably 0.05 to 20 g per liter of the stabilizer tank solution.

Useful compounds as the additive to the stabilizer kit include ammonium compounds, which can be provided by ammonium salts of various inorganic compounds. The adding amount of the ammonium compound is preferably 0.001 mol to 1.0 mol, and more preferably 0.002 to 2.0 mol per mol of the stabilizer tank solution.

Further, the stabilizer preferably contains a sulfite, and also contains a surfactant. Examples of the surfactant include those water-soluble organic siloxane compounds represented by the Formula II described in p.6 of Japanese Patent Application No. 274026/1990 and its exemplified Compounds II-1 to II-17 described in pp.67–70 of the same publication. The preferred among the exemplified compounds are Compounds II-1, II-3, II-7, II-13, II-15, II-16 and II-17. Alternatively, those compounds represented by the Formulas I and II described in JP O.P.I. No. 250449/1987 may be used. For the adding amount of them reference can be made to the same publication.

It is preferable for the stabilizer to contain a metallic salt in combination with the above-mentioned chelating agent. The metallic salt can be provided in the form of an inorganic salt such as the halide, hydroxide, sulfate, carbonate, phosphate or acetate of such a metal as Ba, Ca, Ce, Co, In, La, Mn, Ni, Bi, Pb, Sn, Zn, Ti, Zr, Mg, Al or Sr, or of a water-soluble chelating agent. The using amount of it is preferably $1\times10^{-4}$ to $1\times10^{-1}$ mol, and more preferably $4\times10^{-4}$ to $2\times10^{-2}$ mol per liter of the stabilizer tank solution.

To the stabilizer may be added additives including organic acid salt such as of citric acid, acetic acid, succinic acid, oxalic acid or benzoic acid; a pH control agent such as a phosphate, a borate, a hydrochloride or a sulfate; and a fungicide.

The stabilizer is used at pH of preferably not lower than 6.0, more preferable not lower than 7, and most preferably in the range of 7.5 to 9.0 for the purpose of improving the image preservability.

EXAMPLES

The present invention is illustrated further in detail by the following examples.

EXAMPLE 1

The following parts of a color developer replenisher kit (10-liter kit) for processing color photographic paper were filled in appropriate bags formed each as shown in FIG. 1 by using a film of the structure given in Table 1, and the opening of each bag was heat-sealed, and the respective parts made a set (excluding a hard bottle) to be put in a corrugated cardboard box to thus prepare a kit product form.

| Color developer replenisher for color photographic paper | |
|---|---|
| Part A: | |
| Pure water | about 100 g |
| Triethanolamine | 145 g |
| N,N-diethylhydroxylamine | 70 g |
| Brightening agent | 15 g |
| Diethylene glycol | 145 g |
| Add pure water to make 0.4 liter | |
| Part B: | |
| Pure water | about 300 g |
| Potassium sulfite | 4.3 g |
| N-ethyl-N-β-methanesulfonamidoethyl-3-methyl-4-aminoaniline sulfate | 70 g |
| Add pure water to make 0.4 liter | |
| Part C: | |
| Pure water | about 400 g |
| Potassium carbonate | 350 g |
| Potassium bromide | 0.1 g |
| Potassium chloride | 3 g |
| Sodium diethylenetriaminepentaacetate | 15 g |
| Disodium catechol-3,5-disulfonate | 15 g |
| 1-Hydroxyethylidene-1,1-diphosphonic acid | 15 g |
| Add pure water to make 0.6 liter | |

To make a replenisher solution, the above parts A, B and C are added in the alphabetical order to water for dissolution, and water is added to make the whole 10 liters. Replenishing amount is 162 ml/m$^2$.

To make a starter solution, potassium bromide potassium chloride 2.3 g and 50% sulfuric acid 2.5 g per liter of a starter solution-to-be are added to the replenisher solution in an amount 70% of that of the starter solution to be prepared, and then water is added to make the amount 100%.

Each prepared kit packed in a corrugated cardboard box was set in an oscillation tester to be subjected to 24-hour vibration treatment and then to aging treatment under conditions of 50° C./15%RH in an autoclave over a period of 50 days.

The aged kit was used to prepare a color developer replenisher and starter solutions for processing color photographic paper, and the solutions were loaded in a CL-PP1701 Printer-Processor, manufactured by KONICA Corp. In the printer-processor, a color paper Type QA-A5, produced by KONICA Corp., was used and subjected to wedge exposure in the usual manner and then to running processing. For the bleach-fix and stabilization in the running processing, K-20P2R-01 and K-20P3R-01, produced by KONICA Corp., were used.

The processing steps used are as follows:

| Processing step | Temperature | Time | Rep. amount |
|---|---|---|---|
| (1) Color develop | 35.0 ± 0.3° C. | 45 sec. | 162 ml/m$^2$ |
| (2) Bleach-fix | 35.0 ± 0.3° C. | 45 sec. | 216 ml/m$^2$ |
| (3) Stabilize (Tribath cascade) | 30 ± 34° C. | 90 sec. | 248 ml/m$^2$ |
| (4) Dry | 60 ± 80° C. | 30 sec. | |

The yellow reflection density (Dmin Y) of the unexposed area of each processed color paper sample was measured. Comparison between the test samples was made with respect to the degree of crystal deposition on the color developer tank walls of the processor, the chlorine gas generating degree at the time of the package's incineration, and the volume and weight of the waste kit plastic package for 1000 liters of the processing chemicals. The results are shown in Table 2.

Evaluation Criteria

Deposition on the walls
A: Little or no deposition.
B: Deposition is found.
C: Deposition is conspicuous.
Chlorine gas
A: No chlorine gas was generated in the incineration.
B: Chlorine gas was generated slightly.
C: Chlorine gas was generated to some extent.

TABLE 1

| No. | | In contact with sol. (Inner) . . . Outer | |
|---|---|---|---|
| 1 | Component material | EVA/Ny | Invention |
| | Thickness (μ) | 205/20 | |
| 2 | Component material | EDPE/KPE | Invention |
| | Thickness (μ) | 145/12 | |
| 3 | Component material | LDPE/Ny | Invention |
| | Thickness (μ) | 180/15 | |
| 4 | Component material | TDPE/EVOH/PET | Invention |
| | Thickness (μ) | 150/20/20 | |
| 5 | Component material | EDPE/EVOH/OPP | Invention |
| | Thickness (μ) | 120/15/20 | |
| 6 | Component material | LLDPE/LDPE/HDPE/LLDPE/Ny/EVOH/Ny/PET | Invention |
| | Thickness (μ) | 80/20/40/20/5/5/5/10 | |
| 7 | Component material | LLDPE/GLPET | Invention |
| | Thickness (μ) | 150/15 | |
| 8 | Component material | LLDPE/EVOH/KPET | Invention |

TABLE 1-continued

| No. | | In contact with sol. (Inner) . . . Outer | |
|---|---|---|---|
| | Thickness (μ) | 125/25/20 | |
| 9 | Component material | EVA | Comparative |
| | Thickness (μ) | 180 | |
| 10 | Component material | LDPE | Comparative |
| | Thickness (μ) | 180 | |
| 11 | Component material | HDPE hard bottle | Comparative |
| | Thickness (μ) | 1300 | |
| 12 | Component material | PVC hard bottle | Comparative |
| | Thickness (μ) | 1300 | |

TABLE 2

| No. | Dmin. Y | Deposit on wall of auto-processor | Chlorine gas | Waste plastic wt. (kg) | Waste resin Vol. ($cm^3$) | Remarks |
|---|---|---|---|---|---|---|
| 1 | 0.03 | A | A | 3.6 | 4000 | Invention |
| 2 | 0.03 | B | B | 2.6 | 3000 | Invention |
| 3 | 0.03 | B | A | 3.2 | 3500 | Invention |
| 4 | 0.02 | A | A | 3.0 | 3300 | Invention |
| 5 | 0.01 | A | A | 2.5 | 2700 | Invention |
| 6 | 0.01 | A | A | 3.0 | 3300 | Invention |
| 7 | 0.01 | A | A | 2.7 | 3100 | Invention |
| 8 | 0.01 | A | B | 2.8 | 3100 | Invention |
| 9 | 0.08 | C | A | 2.9 | 3200 | Comparative |
| 10 | 0.09 | C | A | 3.0 | 3300 | Comparative |
| 11 | 0.07 | B–C | A | 14.4 | 180000 | Comparative |
| 12 | 0.02 | A | C | 21.0 | 180000 | Comparative |

As is apparent from Table 2, the invention can provide a silver halide photographic light-sensitive material processing chemicals kit packaging material which, even after being aged, enables to obtain satisfactory photographic characteristics; produces almost no crystal deposition on the autoprocessor's walls; generates little or no harmful chlorine gas at the time of its incineration; and can be easily thrown into the discard because of its collapsibility and its small weight.

EXAMPLE 2

Tests were made in the same manner as in Example 1 except that the thickness of the LDPE and EVOH used in the flexible processing chemicals package material used in the test No.5 in Example 1 was varied to prepare container samples having the following water vapor transmission rates shown in Table 3. The results are shown in Table 3.

TABLE 3

| Test No. | Water vapor transmission rate ($g/m^2 \cdot day$) | Dmin. Y | Deposition on walls |
|---|---|---|---|
| 2-1 | 1.0 | 0.01 | A |
| 2-2 | 2.1 | 0.01 | A |
| 2-3 | 4.8 | 0.01 | A |
| 2-4 | 5.6 | 0.02 | B–A |
| 2-5 | 9.5 | 0.02 | B–A |
| 2-6 | 11.3 | 0.03 | B |
| 2-7 | 15.8 | 0.03 | B |
| 2-8 | 21.3 | 0.03 | B |
| 2-9 | 40.4 | 0.04 | B |
| 2-10 | 61.8 | 0.04 | B |

From Table 3 it is understood that the water vapor transmission rate of the flexible container is preferably not more than 10 $g/m^2$.day, and more preferably not more than 5 $g/m^2$.day.

EXAMPLE 3

Tests were made in the same manner as in Example 1 except that the LLDPE, LDPE and EVOH for the flexible processing chemicals containers used in Test No. 6 of Example 1 were arbitrarily changed to prepare film container samples having the following oxygen transmittances shown in Table 4. The results are shown in Table 4.

TABLE 4

| Test No. | Oxygen transmittance ($ml/m^2 \cdot day \cdot atm$) | Dmin. Y | Deposition on walls |
|---|---|---|---|
| 3-1 | 0.6 | 0.01 | A |
| 3-2 | 1.2 | 0.01 | A |
| 3-3 | 2.8 | 0.01 | A |
| 3-4 | 3.5 | 0.02 | B–A |
| 3-5 | 5.4 | 0.02 | B–A |
| 3-6 | 6.3 | 0.03 | B |
| 3-7 | 9.8 | 0.03 | B |
| 3-8 | 10.6 | 0.05 | B |
| 3-9 | 15.9 | 0.05 | B |

As is apparent from Table 4, the oxygen transmittance of the film container is preferably not more than 10 $ml/m^2$.day.atm, more preferably not more than 6 $ml/m^2$.day.atm, and most preferably not more than 3 $ml/m^2$.day.atm.

EXAMPLE 4

Concentrated bleach-fix solutions of the following parts constitutions for processing color photographic paper were prepared for 4 liters of a replenisher and filled in containers as shown in FIG. 1 made of the packaging material given in Table 5, and the opening 10 of each container was heat-sealed, whereby a kit of bleach-fix solutions for processing color paper was prepared.

| Bleach-fix solutions kit (1) | |
|---|---|
| Part A: | |
| Ammonium thiosulfate (70% aqueous solution) | 400 ml |
| Ammonium sulfite (40% aqueous solution) | 360 g |
| Sodium metasulfite | 120 g |
| Pure water to made 0.8 liter. | |

-continued

| | |
|---|---|
| The solution was filled in a container. | |
| Part B: | |
| Ferric-ammonium ethylenediaminetetraacetate dihydrate | 220 g |
| Ethylenediaminetetraactic acid | 12 g |
| Pure water to make 0.68 liter. | |
| The solution was filled in a container. | |
| Part C: | |
| 90% acetic acid or a compound of Formula B (carboxyl group equivalent molar amount) | 0.88 mol |
| Pure water to make 0.30 liter | |
| Bleach-fix solutions kit (2) | |
| Part A: | |
| Ammonium thiosulfate (70% aqueous solution) | 400 ml |
| Ammonium sulfite (40% aqueous solution) | 360 g |
| Sodium metasulfite | 120 g |
| 90% acetic acid or a compound of Formula B (carboxyl group equivalent molar amount) | 0.44 mol |
| Pure water to make 0.95 liter. | |
| The solution was filled in a container. | |
| Part B: | |
| Ferric-ammonium ethylenediaminetetraacetate dihydrate | 220 g |
| Ethylenediaminetetraacetic acid | 12 g |
| 90% acetic acid or a compound of Formula B (carboxyl group equivalent molar amount) | |
| Pure water to make 0.83 liter. | |
| Bleach-fix solutions kit (3) | |
| Part A | |
| Ammonium thiosulfate (70% aqueous solution) | 400 ml |
| Ammonium sulfite (40% aqueous solution) | 360 g |
| Sodium metasulfite | 120 g |
| Ferric-ammonium ethylenediaminetetraacetate dihydrate | 220 g |
| Ethylenediaminetetraacetic acid | 12 g |
| 90% acetic acid or a compound of Formula B (carboxyl group equivalent molar amount) | 0.88 mol |
| Pure water to make 1.89 liters. | |

The bleach-fix solutions kit for color paper was allowed to stand over a period of three weeks under conditions of 50° C./30%RH. After this period the kit was visually examined with respect to its packaging material's joint sections and stain conditions.

The pH of the replenisher when prepared from the above kit was measured.

The packaging material was evaluated with the following criteria.

Joint sections of the packaging material after aging

A: No degradation is found at all.

B: Slight interlayer gaps are found, but insignificant.

C: Interlayer delamination of the packaging material is found, degrading its value of commodity.

Stain of the packaging material after aging

A: Not stained at all.

B: Slightly stained.

C: Stained dark.

| Packaging material | Oxygen transmittance ml/m$^2$ · 24 hrs · atm |
|---|---|
| a. LDPE 50μ | 2700 |
| b. OPP 20μ/LLDPE 50μ | 2100 |
| c. ONy 30μ/LLDPE 60μ | 25 |
| d. K-ONy 40μ/LLDPE 50μ | 4.0 |
| e. ONy 14μ/LLDPE 50μ | 2.4 |
| g. Ny 15μ/EVOH 12μ/LLDPE 50μ | 2.0 |
| h. OPP 20μ/EVOH 20μ/LLDPE 50μ | 0.4 |
| i. K-ONy 15μ/LLDPE 60μ | 5.0 |
| j. OOP 20μ/LLDPE 40A | 1000 |
| k. K-OPP 20μ/LLDPE 40μ | 4.0 |
| l. ONy 15μ/EVOH 12μ/LLDPE 50μ | 1.0 |
| m. Polyester 12μ/aluminum-evaporated polyester 12μ/LLDPE 40μ | 0.3 |
| n. PET 12μ/Ny 5μ/EVOH 5μ/Ny 5μ LLDPE 25μ/S.PE 25μ/LLDPE 80μ | 0.3 |
| o. ONy 25μ/Ny 5μ/EVOH 5μ/LLDPE 5μ S.PE 20μ/LLDPE 80μ | 0.6 |
| p. PET 12μ/Ny 5μ/EVOH 5 μ/Ny 5μ LLDPE 5μ/S.PE 20μ/HDPE 40μ/ S.PE 2μ/LLDPE 80μ | 1.1 |

LDPE: Low-density polyethylene
OPP: Oriented polypropylene
ONy: Oriented nylon
Ny: Non-oriented nylon
K-ONy: Vinylidene chloride-coated oriented nylon
PNA: Polyvinyl alcohol
EVOH: Ethylene-vinyl alcohol copolymer resin
LLDPE: Linear low-density polyethylene
PET: Polyethylene terephthalate
S.PE: Sand polyethylene

TABLE 5

| Test No. | Packaging material | Oxygen transmittance ml/m$^2$ 24 hrs · atm | Exemplified cpd of Formula B and acetic acid | Kit form | Joint conditions of material after aging | Stain on packaging material | pH |
|---|---|---|---|---|---|---|---|
| 1-1 Comp. | a | 2700 | Acetic acid | (1) | A | A | 5.70 |
| 2 Comp. | b | 2100 | Acetic acid | (1) | C | A | 5.70 |
| 3 Comp. | j | 1000 | Acetic acid | (1) | C | A | 5.60 |
| 4 Comp. | c | 25 | Acetic acid | (1) | C | A | 5.55 |
| 5 Comp. | n | 0.8 | Acetic acid | (1) | C | A | 5.32 |
| 6 Comp. | o | 0.6 | Acetic acid | (1) | C | A | 5.31 |
| 7 Comp. | p | 1.1 | Acetic acid | (1) | C | A | 5.32 |
| 8 Comp. | d | 4.0 | Acetic acid | (1) | C | A | 5.49 |
| 9 Comp. | e | 2.4 | Acetic acid | (1) | C | A | 5.32 |
| 10 Comp. | g | 2.0 | Acetic acid | (1) | C | A | 5.32 |
| 11 Comp. | h | 0.4 | Acetic acid | (1) | C | A | 5.35 |
| 12 Comp. | i | 5.0 | Acetic acid | (1) | C | A | 5.40 |
| 13 Comp. | k | 4.0 | Acetic acid | (1) | C | A | 5.48 |
| 14 Comp. | l | 1.0 | Acetic acid | (1) | C | A | 5.35 |
| 15 Comp. | m | 0.3 | Acetic acid | (1) | C | A | 5.35 |
| 16 Comp. | a | 2700 | B-5 | (1) | A | A | 5.45 |
| 17 Comp. | b | 2100 | B-5 | (1) | A | A | 5.45 |
| 18 Comp. | j | 1000 | B-5 | (1) | A | A | 5.45 |
| 19 Comp. | c | 25 | B-5 | (1) | A | A | 5.36 |

TABLE 6

| Test No. | Packaging material | Oxygen transmittance ml/m$^2$ 24 hrs · atm | Exemplified cpd of Formula B and acetic acid | Kit form | Joint conditions of material after aging | Stain on packaging material | pH |
|---|---|---|---|---|---|---|---|
| 20 Inv. | n | 0.8 | B-5 | (1) | A | A | 5.30 |
| 21 Inv. | o | 0.6 | B-5 | (1) | A | A | 5.30 |
| 22 Inv. | p | 1.1 | B-5 | (1) | A | A | 5.31 |
| 23 Inv. | d | 4.0 | B-5 | (1) | A | A | 5.31 |
| 24 Inv. | e | 2.4 | B-5 | (1) | A | A | 5.31 |
| 25 Inv. | g | 2.0 | B-5 | (1) | A | A | 5.31 |
| 26 Inv. | h | 0.4 | B-5 | (1) | A | A | 5.31 |
| 27 Inv. | i | 5.0 | B-5 | (1) | A | A | 5.30 |
| 28 Inv. | k | 4.0 | B-5 | (1) | A | A | 5.32 |
| 29 Inv. | l | 1.0 | B-5 | (1) | A | A | 5.32 |
| 30 Inv. | m | 0.3 | B-5 | (1) | A | A | 5.31 |
| 31 Inv. | h | 0.4 | B-5 | (1) | A | A | 5.30 |
| 32 Inv. | n | 0.8 | B-5 | (1) | A | A | 5.30 |
| 33 Inv. | o | 0.6 | B-5 | (1) | A | A | 5.30 |
| 34 Inv. | p | 1.1 | B-5 | (1) | A | A | 5.30 |
| 35 Inv. | h | 0.4 | B-16 | (1) | A | A | 5.30 |
| 36 Inv. | n | 0.8 | B-16 | (1) | A | A | 5.30 |

TABLE 7

| Test No. | Packaging material | Oxygen transmittance ml/m$^2$ 24 hrs · atm | Exemplified cpd of Formula B and acetic acid | Kit form | Joint conditions of material after aging | Stain on packaging material | pH |
|---|---|---|---|---|---|---|---|
| Invention | o | 0.6 | B-16 | (1) | | A | 5.30 |
| Invention | p | 1.1 | B-16 | (1) | | A | 5.31 |
| Comparative | j | 2700 | Acetic acid | (2) | B | C | 5.80 |
| Comparative | j | 1000 | Acetic acid | (2) | C–B | C | 5.65 |
| Comparative | l | 1.0 | Acetic acid | (2) | C | C | 5.38 |
| Comparative | n | 0.8 | Acetic acid | (2) | C | C | 5.37 |
| Comparative | o | 0.6 | Acetic acid | (2) | C | B–C | 5.37 |
| Comparative | p | 1.1 | Acetic acid | (2) | | C | 5.38 |
| Comparative | a | 2700 | B-5 | (2) | A | B–C | 5.50 |
| Comparative | j | 1000 | B-5 | (2) | A | B–C | 5.50 |
| Invention | l | 1.0 | B-5 | (2) | A | A | 5.32 |
| Invention | n | 0.8 | B-5 | (2) | A | A | 5.32 |
| Invention | o | 0.6 | B-5 | (2) | A | A | 5.32 |
| Invention | p | 1.1 | B-5 | (2) | A | A | 5.33 |
| Invention | g | 2.0 | B-5 | (2) | A | A | 5.33 |
| Invention | l | 1.0 | B-6 | (2) | A | A | 5.32 |
| Invention | n | 0.8 | B-6 | (2) | A | A | 5.32 |
| Comparative | a | 2700 | Acetic acid | (3) | B | C | 5.91 |
| Comparative | j | 1000 | Acetic acid | (3) | B | C | 5.88 |

TABLE 8

| Test No. | Packaging material | Oxygen transmittance ml/m$^2$ 24 hrs · atm | Exemplified cpd of Formula B and acetic acid | Kit form | Joint conditions of packaging material after aging | Stain on packing material | pH |
|---|---|---|---|---|---|---|---|
| Comparative | l | 1.0 | Acetic acid | (3) | B–C | B | 5.45 |
| " | n | 0.8 | " | " | C | B | 5.45 |
| " | o | 0.6 | " | " | C | B | 5.44 |
| " | p | 1.1 | " | " | C | B | 5.45 |
| " | a | 2700 | B-5 | " | A | A–B | 5.55 |
| " | j | 1000 | " | " | A | A–B | 5.35 |
| Invention | l | 1.0 | " | " | A | A | 5.35 |
| " | n | 0.8 | " | " | A | A | 5.34 |
| " | o | 0.6 | " | " | A | A | 5.35 |
| " | p | 1.1 | " | " | A | A | 5.35 |
| " | g | 2.0 | " | " | A | A | 5.34 |
| " | l | 1.0 | B-6 | " | A | A | 5.34 |
| " | n | 0.8 | " | " | A | A | 5.34 |

As is apparent from Table 5, the packaging material of the invention is not degraded nor stained during its storage. The replenisher prepared from the kit that has been aged has an excellently stable pH value. As for the kit constitution, a plural parts constitution is preferred to a single part constitution.

EXAMPLE 5

A concentrated bleaching solution of the following part constitution for color negatives were prepared for 5 liters of a replenisher solution and filled in a container as shown in FIG. 1 made of the packaging material given in Table 5, and the opening of the container was heat-sealed, whereby a bleaching solution kit was prepared.

| Bleaching solutions kit (1) | |
|---|---|
| Ferric salt of A-1 | 0.45 mol |
| Ethylenediaminetetraacetic acid | 2 g |
| Ammonium bromide | 1.4 mols |
| 90% acetic acid or a compound of Formula B (carboxyl group equivalent molar amount) | 1.3 mols |
| Ammonium nitrate | 120 g |
| 25% ammonia water | 8.5 g |
| Pure water to make 0.70 liter. | |

The above bleaching solution kit for color negative films was allowed to stand over a period of three weeks at 50° C./30% RH.

The conditions of the joint section and stain of the packaging material of the kit after being aged were visually examined. And the pH of the aged kit was measured.

TABLE 9

| Test No. | Packaging material | Exemplified compound of Formula B or acetic acid | Join condition of packaging material after aging | Stain on packaging material | pH |
|---|---|---|---|---|---|
| Comparative | a | Acetic acid | C | C | 3.70 |
| " | j | " | C | C | 3.65 |
| " | c | " | C | C | 3.60 |
| " | n | " | C | B–C | 3.60 |
| " | o | " | C | B–C | 3.59 |
| " | p | " | C | B–C | 3.59 |
| " | d | " | C | C | 3.61 |
| " | g | " | C | C | 3.62 |
| " | w | " | C | C | 3.62 |
| " | a | B-5 | A–B | B | 3.60 |
| " | j | " | A–B | B | 3.59 |
| Invention | c | " | A | A | 3.53 |
| " | n | " | A | A | 3.50 |
| " | o | " | A | A | 3.50 |
| " | p | " | A | A | 3.50 |
| " | d | " | A | A | 3.52 |
| " | g | " | A | A | 3.52 |
| " | h | " | A | A | 3.51 |
| " | n | B-6 | A | A | 3.50 |
| " | " | B-6/B-5 | A | A | 3.51 |
| " | " | B-16 | A | A | 3.51 |

EXAMPLE 6

The same concentrated bleach-fix solutions for color photographic papers as those of Example 1 were filled in the packaging materials shown in Table 6. Tests were made with use of the following ones in addition to those used in Example 4.

q ONy 14μ/EVOH 5μ/LLDPE 40μ
r ONy 14μEVOH 5μ/LLDPE 30μ
s ONy 14μ/EVOH 5μ/LLDPE 20μ
t ONy 14μ/EVOH 5μ/LLDPE 10μ
u ONy 14μ/PVA 40μ/PET 5μ

The solutions were allowed to stand similarly to Example 4. The weights of the kit before and after its aging were measured to find the reduction rate of the kit contents therefrom. The joint condition of the packaging material after its aging was examined visually.

TABLE 10

| Test No. | Packaging material | Oxygen transmittance ml/m$^2$ 24 hrs · atm | water vapor transmission rate g/m$^2$ · day | Ex. cpd of Formula B or Acetic acid | Reduciton rate of kit content (%) | Joint condition of packaging material |
|---|---|---|---|---|---|---|
| Invention | u | 4.0 | 100 | B-5 | 5% | A–B |
| " | t | 1.5 | 60 | " | 3.0% | A |
| " | s | 1.4 | 30 | " | 2.5% | A |
| " | r | 1.3 | 20 | " | 1% | A |
| " | q | 1.2 | 15 | " | 0.5% | A |
| " | g | 2.0 | 10 | " | 0.1% | A |
| " | k | 4.0 | 8 | " | 0.05% | A |
| " | n | 0.8 | 2.3 | " | 0.03% | A |
| " | o | 0.6 | 4.2 | " | 0.05% | A |
| " | p | 1.1 | 1.8 | " | 0.01% | A |

It is understood that the use of the packaging material having a water vapor transmission rate of not more than 10 g/m$^2$.day is more preferable to lower the reduction rate of its content.

EXAMPLE 7

Preparation of a silver halide photographic light-sensitive material (color photographic paper)

A paper support laminated with polyethylene on one side thereof and with a titanium oxide-containing polyethylene on the other side thereof was used to coat on the titanium oxide-containing polyethylene-laminated side the following component layers in the described order from the support, whereby a multilayer silver halide color photographic light-sensitive material was prepared.

| Layer | Components | Added amt (g/m$^2$) |
|---|---|---|
| Layer 7 (Protective layer) | Gelatin | 1.0 |
| Layer 6 (UV absorbing layer) | Gelatin | 0.35 |
| | UV absorbent UV-1 | 0.10 |
| | UV absorbent UV-2 | 0.04 |
| | UV absorbent UV-3 | 0.18 |
| | Antistain agent HQ-1 | 0.01 |
| | DNP | 0.18 |
| | PVP | 0.03 |
| | Antiirradiation dye AI-2 | 0.02 |
| Layer 5 (Red-sensitive layer) | Gelatin | 1.21 |
| | Red-sensitive silver chloride emulsion EmC, Ag equivalent | 0.17 |
| | Cyan coupler C-1 | 0.20 |
| | Cyan coupler C-2 | 0.20 |
| | Dye image stabilizer ST-1 | 0.20 |
| | Antistain agent HQ-1 | 0.01 |
| | HBS-1 | 0.20 |
| | DOP | 0.20 |
| Layer 4 (UV absorbing layer) | Gelatin | 0.90 |
| | UV absorbent UV-1 | 0.28 |
| | UV absorbent UV-2 | 0.08 |
| | UV absorbent UV-3 | 0.38 |
| | Antistain agent HQ-1 | 0.03 |
| | DNP | 0.35 |

-continued

| Layer | Components | Added amt ($g/m^2$) |
|---|---|---|
| Layer 3 (Green-sensitive layer) | Gelatin | 1.40 |
| | Green-sensitive silver chloride emulsion EmB, Ag equivalent | 0.14 |
| | Magenta coupler M-C | 0.30 |
| | Dye image stabilizer ST-3 | 0.15 |
| | Dye image stabilizer ST-4 | 0.15 |
| | Dye image stabilizer ST-5 | 0.15 |
| | DNP | 0.20 |
| | Antiirradiation dye AI-1 | 0.02 |
| Layer 2 (Interlayer) | Gelatin | 1.20 |
| | Antistain agent HQ-2 | 0.12 |
| | DIDP | 0.15 |
| Layer 1 (Blue-sensitive layer) | Gelatin | 1.20 |
| | Blue-sensitive silver chloride emulsion EmA, Ag equivalent | 0.23 |
| | Yellow coupler Y-1 | 0.82 |
| | Dye image stabilizer ST-1 | 0.30 |
| | Dye image stabilizer ST-2 | 0.20 |
| | Antistain agent HQ-1 | 0.02 |
| | Antiirradiation dye AI-3 | 0.02 |
| | DNP | 0.20 |
| Support | Polyethylene-laminated paper | |

The coating liquid for the above layers were prepared as follows:

Layer 1 coating liquid

A solution of 26.7 g of yellow coupler Y-1, 100 g of dye image stabilizer ST-1, 6.67 g of ST-2 and 0.67 g of additive HQ-1 dissolved in 6.67 g of high-boiling solvent DNP with 60 cc of ethyl acetate was emulsifiedly dispersed by means of a supersonic homogenizer into 220 cc of aqueous 10% gelatin solution containing 7 cc of 20% surfactant SU-1 to thereby prepare a yellow coupler dispersion. This dispersion was mixed with a blue-sensitive silver halide emulsion (containing 10 g of silver) that was prepared in the following manner, whereby a Layer-1 coating liquid was obtained.

Layer-2 to Layer-7 coating liquids also were prepared in similar manner to the above Layer-1 coating liquid.

Hardening agent H-1 was added to Layer-2 and Layer-4, and H-2 to Layer-7. As the coating aid surfactants SU-2 and SU-3 were added to the above liquids for their surface tension adjustment.

The structural formulas of the foregoing compounds added to the above light-sensitive material are given below:

Y-1

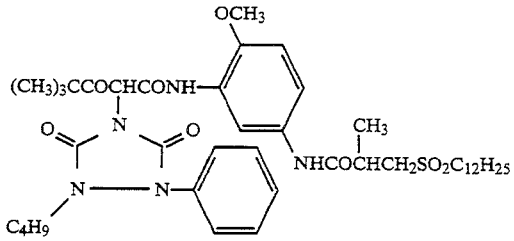

M-C

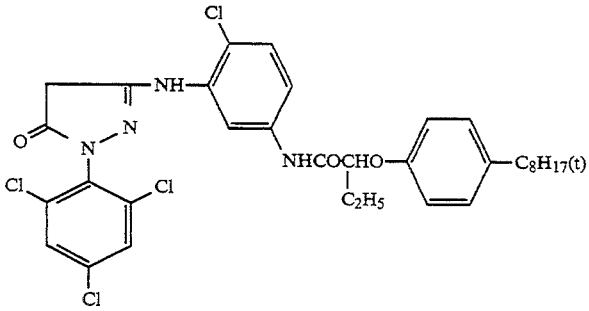

C-1

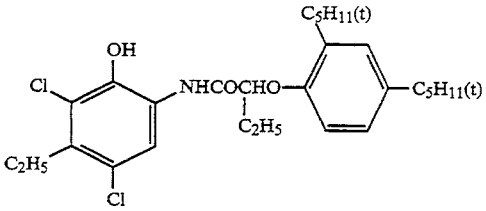

C-2

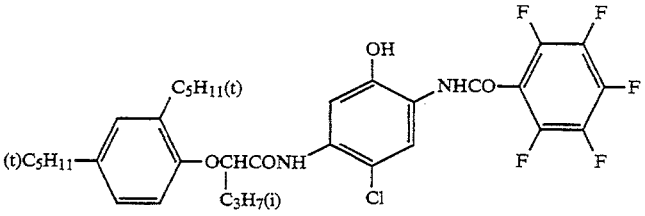

-continued
ST-1
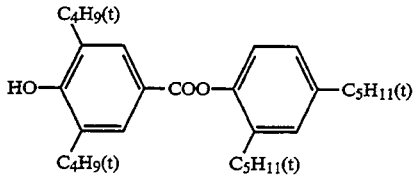
ST-2
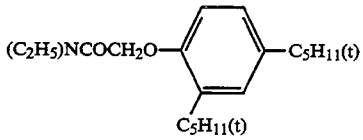
ST-3
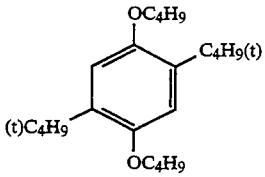
ST-4
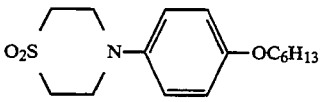
ST-5
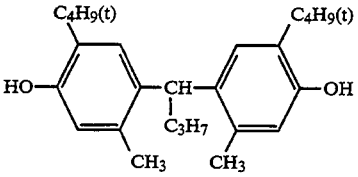
UV-1
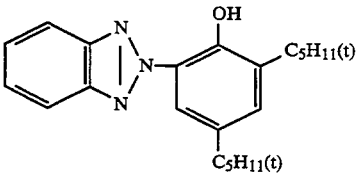
UV-2
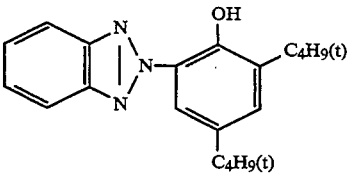
UV-3
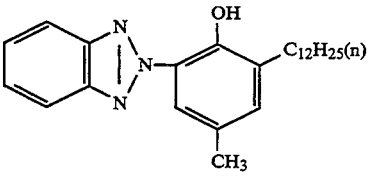
DOP Dioctyl phthalate
DNP Dinonyl phthalate
DIDP Diisodecyl phthalate
PVP Polyvinyl pyrolidone
HQ-1
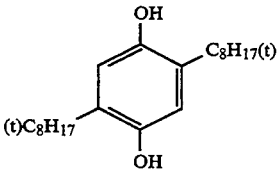

-continued

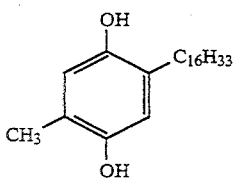
HQ-2

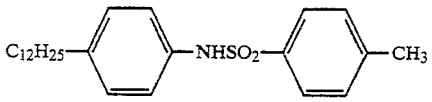
HBS-1

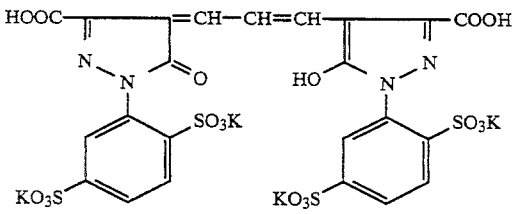
AI-1

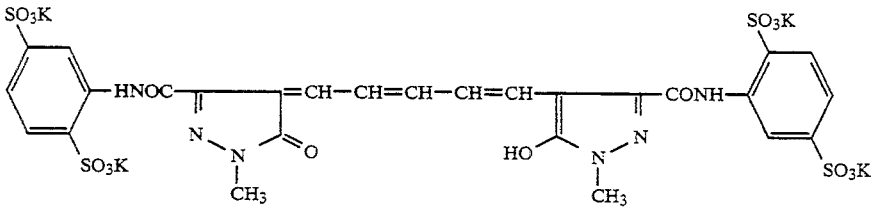
AI-2

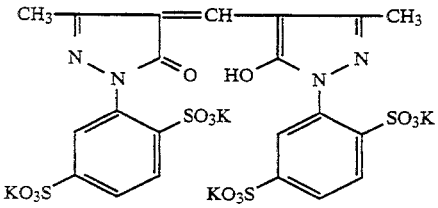
AI-3

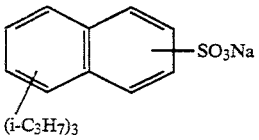
SU-1

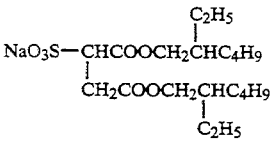
SU-2

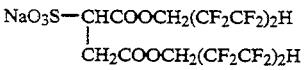
SU-3

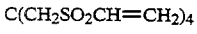
H-1

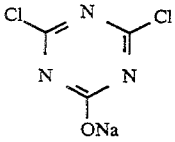
H-2

Preparation of a blue-sensitive silver halide emulsion

To 1000 cc of an aqueous 2% gelatin solution kept at 40° C. the following Solutions A and B were added simultaneously with pAg and pH controlled to 6.5 and 3.0, respectively, spending 30 minutes, and further the following Solutions C and D simultaneously with pAg and pH controlled to 7.3 and 5.5, respectively, spending 180 minutes.

In this instance, the pAg control was made according to the method described in JP O.P.I. No.45437/1984, while the pH control was made with use of an aqueous solution of sulfuric acid or sodium hydroxide.

| | |
|---|---|
| Solution A | |
| Sodium chloride | 3.42 g |
| Potassium bromide | 0.03 g |
| Water to make | 200 cc |
| Solution B | |
| Silver nitrate | 10 g |
| Water to make | 200 cc |
| Solution C | |
| Sodium chloride | 102.7 g |
| Potassium bromide | 1.0 g |
| Water to make | 600 cc |
| Solution D | |
| Silver nitrate | 300 g |
| Water to make | 600 cc |

After completion of the addition, the emulsion was desalted by using an aqueous 5% solution of Demol N, produced by Kawo Atlas Co., and an aqueous 20% magnesium sulfate solution, and then mixed with an aqueous gelatin solution, whereby a monodisperse cubic emulsion EM P-1, having an average grain size of 0.85 μm, a grain size distribution with a coefficient of variation of 7% and a silver chloride content of 99.5 mol % was obtained.

The above emulsion EMP-1 was subjected to a 90-minute chemical ripening treatment at 50° C. with use of the following compounds, whereby a blue-sensitive silver halide emulsion Em-A was obtained.

| | |
|---|---|
| Sodium thiosulfate | 0.8 mg/mol AgX |
| Chloroauric acid | 0.5 mg/mol AgX |
| Stabilizer STAB-1 | $6 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of a green-sensitive silver halide emulsion

A monodisperse cubic emulsion EMP-2, having an average grain size of 0.43 μm, a grain size distribution with a coefficient of variation of 8% and a silver chloride content of 99.5 mol %, was prepared in the same manner as in EMP-1 except that the adding time of Solutions A and B and that of Solutions C and D were changed.

The emulsion EMP-2 was subjected to a 120-minute chemical ripening treatment at 55° C. with use of the following compounds, whereby a green-sensitive silver halide emulsion Em-B was obtained.

| | |
|---|---|
| Sodium thiosulfate | 1.5 mg/mol AgX |
| Chloroauric acid | 1.0 mg/mol AgX |
| Stabilizer STAB-1 | $6 \times 10^{-4}$ mol/mol AgX |
| Sensitizing dye GS-1 | $4 \times 10^{-4}$ mol/mol AgX |

Preparation of a red-sensitive silver halide emulsion

A monodisperse cubic emulsion EMP-3, having an average grain size of 0.50 μm, a grain size distribution with a coefficient of variation of 8% and a silver chloride content of 99.5 mol %, was prepared in the same manner as in EMP-1 except that the adding time of Solutions A and B and that of Solutions C and D were changed.

The emulsion EMP-3 was subjected to a 90-minute chemical ripening treatment at 60° C. with use of the following compounds, whereby a red-sensitive silver halide emulsion Em-C was obtained.

| | |
|---|---|
| Sodium thiosulfate | 1.8 mg/mol AgX |
| Chloroauric acid | 2.0 mg/mol AgX |
| Stabilizer STAB-1 | $6 \times 10^{-4}$ mol/mol AgX |
| Sensitizing dye RS-1 | $4 \times 10^{-4}$ mol/mol AgX |

The structural formulas of the compounds that were used in preparing the above emulsions are shown below.

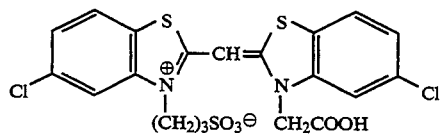

BS-1

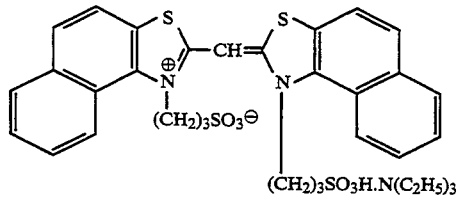

BS-2

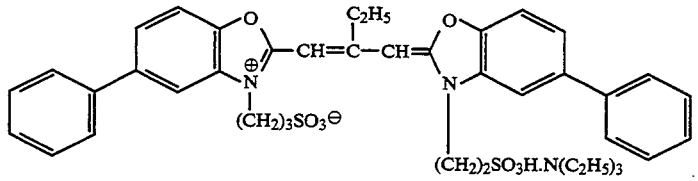

GS-1

-continued

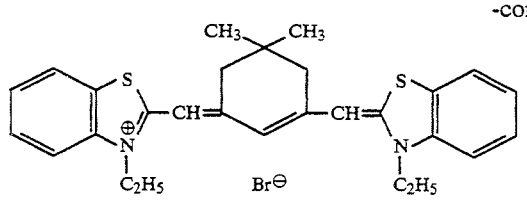

RS-1

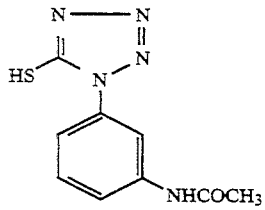

STAB-1

The sample was exposed in the usual manner, and then processed in the following procedure with use of the following processing solutions.

| Processing step | temperature | time | Rep. amt. |
|---|---|---|---|
| (1) Color develop | 39.0 ± 0.3° C. | 20 sec. | 55 cc./m |
| (2) Bleach-fix | 37.5 ± 0.5° C. | 20 sec. | 55 cc./$m^2$ |
| (3) Stabilize (Tribath cascade) | 30–34° C. | 90 sec. | 248 cfc./$m^2$ |
| (4) Dry | 60–80° C. | 30 sec. | |

| Color developer | |
|---|---|
| Triethanolamine | 10 g |
| Diethylene glycol | 10 g |
| N,N-diethyl-hydroxylamine | 5.0 g |
| Potassium bromide | 20 mg |
| Potassium chloride | 2.5 g |
| Diethylenetriaminepentaacetic acid | 5 g |
| Potassium sulfite | 0.2 g |
| Color developing agent (3-methyl-4-amino-N-ethyl-N-(β-methanesulfonamidoethyl)-aniline sulfate | 6.0 g |
| Potassium carbonate | 25 g |
| Potassium hydrogencarbonate | 5 g |
| Water to make 1 liter. | |
| Adjust pH to 10.10 with use of potassium hydroxide or sulfuric acid. | |
| **Color developer replenisher** | |
| Triethanolamine | 14.0 g |
| Diethylene glycol | 12 g |
| N,N-diethyl-hydroxylamine | 7.5 g |
| Potassium chloride | 0.1 g |
| Diethylenetriaminepentaacetic acid | 7.5 g |
| Potassium sulfite | 0.3 mol |
| Color developing agent (3-methyl-4-amino-N-ethyl-N-(β-methanesulfonamidoethyl)-aniline sulfate | 9.8 g |
| Potassium carbonate | 30 g |
| Potassium hydrogencarbonate | 1 g |
| Water to make 1 liter. | |
| Adjust pH to 10.65 with use of potassium hydroxide or sulfuric acid. | |

Bleach-fix replenisher

A bleach-fix chemicals kit for making 10 liters of bleach-fix replenisher solutions was prepared in the same manner as in Example 4.

| Bleach-fix chemicals kit (1) | |
|---|---|
| **Part A** | |
| Ammonium thiosulfate (70% solution) | 1000 ml |
| Ammonium sulfite (40% solution) | 900 g |
| Sodium metasulfite | 300 g |
| Water to make 2.0 liters. | |
| The solution was put in a container. | |
| **Part B** | |
| Ferric-ammonium ethylenediaminetetra-acetate, dehydrate | 550 g |

-continued

| | |
|---|---|
| Ethylenediaminetetraacetic acid | 30 g |
| Pure water to make 1.70 liter. | |
| The solution was put in a container. | |
| **Part C** | |
| 90% acetic acid or a compound of Formula B (carboxyl group equivalent molar amount) | 2.2 mols |
| Pure water to make 0.75 liter. | |

| Bleach-fix chemicals kit (2) | |
|---|---|
| **Part A** | |
| Ammonium thiosulfate (70% solution) | 1000 ml |
| Ammonium sulfite (40% solution) | 900 g |
| Sodium metasulfite | 300 g |
| 90% acetic acid or a compound of Formula B (carboxyl group equivalent amount) | 1.1 mols |
| Pure water to make 2.38 liters. | |
| The solution was put in a container. | |
| **Part B** | |
| Ferric-ammonium ethylenediaminetetra-acetate, dehydrate | 550 g |
| Ethylenediaminetetraacetic acid | 30 g |
| 90% acetic acid or a compound of Formula B (carboxyl group equivalent amount) | 1.1 mols |
| Pure water to make 2.08 liters. | |

The above bleach-fix chemicals kit for color paper was allowed to stand under conditions of 50° C./30%RH over a period of three weeks, and thereafter was dissolved in water to prepare a bleach-fix replenisher solution.

Bleach-fix bath

The above bleach-fix solution was diluted with water to make its concentration 0.8-fold and its pH was adjusted to 7.0.

| Stabilizer bath and stabilizer replenisher | |
|---|---|
| o-Phenyl-phenol | 0.1 g |
| Uvitex MST, produced by Ciba Geigy | 1.0 g |
| Zinc sulfate | 0.2 g |
| Ammonium sulfite (40% solution) | 5.0 ml |
| 1-Hydroxyethylidene-1,1-diphosphonic acid (60% solution) | 5.0 g |
| Ethylenediaminetetraacetic acid | 1.5 g |
| Water to make 1 liter. | |
| Adjust pH to 7.8 with use of ammonia water or sulfuric acid. | |

The color photographic paper, developer and developer replenisher that were prepared earlier, were used along with the above prepared bleach-fix, stabilizer and their replenishers to make running processing.

The running processing was made in the manner that the color photographic paper was continually processed by an automatic processor with its respective tanks filled with the foregoing color developer, bleach-fix and stabilizer solutions while being replenished by supplying through metering pumps the above color developer replenisher, bleach-fix replenisher and stabilizer replenisher, respectively.

The running processing was lasted until the time when the amount of the bleach-fix replenisher supplied to the bleach-fix tank solution comes to three times the capacity of the bleach-fix solution tank.

After the processing, the color paper was divided into two, of which one was exposed to fluorescent X-rays to examine the residual silver amount in its exposed area, while the other was examined with respect to the yellow density in its unexposed area.

TABLE 13

| Test No. | Packaging material | Kit form | Cpd. of Formula B or acetic acid | Residual silver mg/100 $cm^2$ | Unexposed area's reflection Y density |
|---|---|---|---|---|---|
| Comparative | a | (1) | Acetic acid | 3.0 | 0.06 |
| Comparative | j | (1) | Acetic acid | 2.9 | 0.06 |
| Comparative | n | (1) | Acetic acid | 2.5 | 0.05 |
| Comparative | p | (1) | Acetic acid | 2.4 | 0.05 |
| Comparative | a | (1) | B-5 | 1.2 | 0.05 |
| Comparative | j | (1) | B-5 | 1.0 | 0.05 |
| Invention | c | (1) | B-5 | 0.2 | 0.02 |
| Invention | n | (1) | B-5 | 0.1 | 0.02 |
| Invention | o | (1) | B-5 | 0.1 | 0.02 |
| Invention | p | (1) | B-5 | 0.1 | 0.02 |
| Invention | n | (1) | B-6 | 0.1 | 0.02 |
| Invention | n | (1) | B-16 | 0.2 | 0.02 |
| Invention | n | (1) | B-21 | 0.2 | 0.03 |
| Comparative | a | (2) | Acetic acid | 4.0 | 0.08 |
| Invention | c | (2) | B-5 | 0.3 | 0.03 |
| Invention | n | (2) | B-5 | 0.1 | 0.02 |
| Invention | o | (2) | B-5 | 0.1 | 0.02 |
| Invention | p | (2) | B-5 | 0.1 | 0.02 |
| Invention | n | (2) | B-6 | 0.2 | 0.02 |
| Invention | n | (2) | B-16 | 0.2 | 0.02 |

As is apparent from Table 13, the invention enables to obtain satisfactory bleachability and also to restrain the yellow stain low.

EXAMPLE 8

A color paper similar to that of Example 4 was prepared and it was subjected to running processing likewise.

The kinds of the packaging material were changed as shown in the following Table 14. Evaluations were made in the same manner as in Example 7.

TABLE 14

| Test No. | Packaging material | Oxygen transmittance $ml/m^2$ 24 hrs · atm | Water vapor transmission rate $g/m^2 \cdot day$ | Exemplified compound of Formula B | Residual amount of silver | Unexposed area's reflection Y density |
|---|---|---|---|---|---|---|
| Invention | u | 4.0 | 100 | B-5 | 0.3 | 0.07 |
| Invention | T | 1.5 | 60 | B-5 | 0.2 | 0.06 |
| Invention | S | 1.4 | 30 | B-5 | 0.2 | 0.05 |
| Invention | r | 1.3 | 20 | B-5 | 0.2 | 0.05 |
| Invention | g | 1.2 | 15 | B-5 | 0.2 | 0.05 |
| Invention | g | 2.0 | 10 | B-5 | 0.1 | 0.00 |
| Invention | k | 4.0 | 8 | B-5 | 0.1 | 0.03 |
| Invention | n | 0.8 | 2.3 | B-5 | 0.1 | 0.02 |
| Invention | o | 0.6 | 4.2 | B-5 | 0.1 | 0.02 |
| Invention | p | 1.1 | 1.8 | B-5 | 0.1 | 0.02 |

As is apparent from Table 14, the use of a packaging material having a water vapor transmission rate of not more than 10 $g/m^2$.day enables the invention to exhibit its better effect upon the bleachability and yellow stain.

EXAMPLE 9

The following color developing part chemicals and its replenisher chemicals were filled in packaging materials made in the pouch form as shown in FIG. 1 with use of a film of the composition shown in Table 15, and the opening of each pouch was hermetically sealed by heating.

| | |
|---|---|
| (1) Color negative film color-developing part chemicals (for 10 liters) | |
| Preservative described in Tables 16 to 18 | 0.5 mol |
| Surface active agent | 2.0 g |
| Pure water to make 200 ml. | |
| (2) Color paper color-developing part chemicals (for 10 liters) | |
| Triethanolamine | 100 g |
| Preservative shown in Tables 16 to 18 | 0.5 mol |
| Brightening agent Cinopal SFP | 15 g |
| Diethylene glycol | 140 g |
| Sodium diethylenetriaminepentaacetate | 10 g |
| Sodium p-toluenesulfonate | 40 g |
| Pure water to make 550 ml. | |
| (3) Color paper color-developer replenisher (for 1 liter) | |
| Triethanolamine | 10 g |
| Diethylene glycol | 14 g |
| Brightening agent Cinopal SFP | 1.5 g |
| Preservative in Tables 16 to 18 | $3.5 \times 10^{-2}$ g |
| Sodium diethylenetriaminepentaacetate | 4 g |
| p-Toluenesulfonic acid | 30 g |
| Potassium sulfite | 0.5 g |
| Potassium carbonate | 30 g |
| Potassium hydroxide | 20 g |
| Potassium bromide | $3.0 \times 10^{-2}$ g |
| Pure water to make 1 liter | |

The above color developer part chemicals kit was allowed to stand in a thermostat cabinet conditioned at 50° C./30%RH over a period of one month. After the aging, the degraded degree of the container's joint section was examined visually.In order to test the strength of the aged pouch container, it was dropped from heights of 3 meters and 5 meters to see if liquid leakage occurs.

Dgradation of joint section

No degradation of joint section

A: No degradation was found at all in the joint section.

B: Slight peeling was found locally, but there was no liquid leakage.

C: Liquid leakage was found.

Drop test

A: NO liquid leakage occurred even when the container was dropped from a height of 5 meters.

B: No liquid leakage occurred when the container was dropped from a height of 3 miters.

C: Liquid leakage was found when the container was dropped from a height of 3 meters.

TABLE 15

| No. | (Outside ←Composition → liquid side) | Oxygen transmittance cc/m$^2$ · day/atm |
|---|---|---|
| a | LDPE50μ | 2700 |
| b | OPP20μ/LLDPE40μ | 1000 |
| c | ONy30μ/LLDPE60μ | 25 |
| d | K-ONy15μ/LLDPE60μ | 5 |
| e | K-OPP20μ/LLDPE40μ | 4 |
| f | Ny15μ/EVOH12μ/LLDPE50μ | 2 |
| g | PET12μ/Ny5μ/EVOH5μ/Ny5μ/LLDPE5μ/S.PE20μ/HDPE40μ/S.PE20μ/LLDPE80μ | 1.1 |
| h | PET12μ/Ny5μ/EVOH5μ/Ny5μ/LLDPE5μ/S.PE20μ/LLDPE80μ | 0.8 |
| i | ONy25μ/Ny5μ/EVOH5μ/Ny5μ/LLDPE5μ/S.PE20μ/LLDPE80μ | 0.6 |
| j | OPP20/EVOH20μ/LLDPE50μ | 0.4 |

LDPE: Low-density polyethylene
LLDPE: Linear low-density polyethylene
OPP: Oriented polypropylene
ONy: Oriented nylon
Ny: Non-oriented nylon
K-ONy: Vinylidene chloride-coated oriented nylon
EVOH: Ethylene-vinyl alcohol copolymer resin
PET: Polyethylene terephthalate
S.PE: Sand polyethylene

TABLE 16

| Test No. | Packaging material | Oxygen transmittance cc/m$^2$ · day · atm | Dev. part | Preservative | Degradation of joint section | Strength |
|---|---|---|---|---|---|---|
| 1-1 (Comp.) | a | 2700 | (1) | Hydroxylamine sulfate | C | C |
| 1-2 (Comp.) | b | 1000 | (1) | Hydroxylamine sulfate | C | C |
| 1-3 (Comp.) | c | 25 | (1) | Hydroxylamine sulfate | C | C |
| 1-4 (Comp.) | d | 5 | (1) | Hydroxylamine sulfate | C | C |
| 1-5 (Comp.) | e | 4 | (1) | Hydroxylamine sulfate | C | C |
| 1-6 (Comp.) | f | 2 | (1) | Hydroxylamine sulfate | C | C |
| 1-7 (Comp.) | g | 1.1 | (1) | Hydroxylamine sulfate | C | C |
| 1-8 (Comp.) | h | 0.8 | (1) | Hydroxylamine sulfate | C | C |
| 1-9 (Comp.) | i | 0.6 | (1) | Hydroxylamine sulfate | C | C |
| 1-10 (Comp.) | j | 0.4 | (1) | Hydroxylamine sulfate | C | C |
| 1-11 (Comp.) | a | 2700 | (1) | (2) | C | C |
| 1-12 (Comp.) | b | 1000 | (1) | (2) | C | C |
| 1-13 (Comp.) | c | 25 | (1) | (2) | C | C |
| 1-14 (Inv.) | d | 5 | (1) | (2) | B | B |
| 1-15 (Inv.) | e | 4 | (1) | (2) | B | B |
| 1-16 (Inv.) | f | 2 | (1) | (2) | A | B |
| 1-17 (Inv.) | g | 1.1 | (1) | (2) | A | B |

TABLE 17

| Test No. | Packaging material | Oxygen transmittance cc/m$^2$ · day · atm | Dev. part | Preservative | Degradation of joint section | Strength |
|---|---|---|---|---|---|---|
| 1-18 (Inv.) | h | 0.8 | (1) | Hydroxylamine sulfate | A | A |
| 1-19 (Inv.) | i | 0.6 | (1) | Hydroxylamine sulfate | A | A |
| 1-20 (Inv.) | j | 0.4 | (1) | Hydroxylamine sulfate | A | A |
| 1-21 (Comp.) | a | 2700 | (1) | (7) | C | C |
| 1-22 (Comp.) | b | 1000 | (1) | (7) | C | C |
| 1-23 (Comp.) | c | 25 | (1) | (7) | C | C |
| 1-24 (Inv.) | d | 5 | (1) | (7) | B | B |
| 1-25 (Inv.) | e | 4 | (1) | (7) | B | B |

TABLE 17-continued

| Test No. | Packaging material | Oxygen transmittance cc/m$^2$ · day · atm | Dev. part | Preservative | Degradation of joint section | Strength |
|---|---|---|---|---|---|---|
| 1-26 (Inv.) | f | 2 | (1) | (7) | A | B |
| 1-27 (Inv.) | g | 1.1 | (1) | (7) | A | B |
| 1-28 (Inv.) | h | 0.8 | (1) | (2) | A | A |
| 1-29 (Inv.) | i | 0.6 | (1) | (2) | A | A |
| 1-30 (Inv.) | j | 0.4 | (1) | (2) | A | A |
| 1-31 (Comp.) | c | 25 | (2) | Diethyl hydroxylamine | C | C |
| 1-32 (Comp.) | d | 5 | (2) | Diethyl hydroxylamine | C | C |
| 1-33 (Comp.) | g | 1.1 | (2) | Diethyl hydroxylamine | C | C |
| 1-34 (Comp.) | h | 0.8 | (2) | Diethyl hydroxylamine | C | C |
| 1-35 (Comp.) | c | 25 | (2) | (2) | C | C |

TABLE 18

| Test No. | Packaging material | Oxygen transmittance cc/m$^2$ · day · atm | Dev. part | Preservative | Degradation of joint section | Strength |
|---|---|---|---|---|---|---|
| 1-36 (Inv.) | d | 5 | (1) | (2) | B | B |
| 1-37 (Inv.) | g | 1.1 | (1) | (2) | A | B |
| 1-38 (Inv.) | h | 0.8 | (1) | (2) | A | A |
| 1-39 (Comp.) | c | 25 | (1) | (7) | C | C |
| 1-40 (Inv.) | d | 5 | (1) | (7) | B | B |
| 1-41 (Inv.) | g | 1.1 | (1) | (7) | A | B |
| 1-42 (Inv.) | h | 0.8 | (1) | (7) | A | A |
| 1-43 (Inv.) | h | 0.8 | (1) | (14) | A | B |
| 1-44 (Inv.) | h | 0.8 | (1) | (38) | A | A |
| 1-45 (Inv.) | h | 0.8 | (1) | (39) | A | A |
| 1-46 (Inv.) | h | 0.8 | (1) | (40) | A | B |
| 1-47 (Inv.) | h | 0.8 | (1) | (55) | A | B |
| 1-48 (Comp.) | h | 0.8 | (3) | Diethyl hydroxylamine | C | C |
| 1-49 (Inv.) | h | 0.8 | (3) | (2) | A | B |
| 1-50 (Inv.) | h | 0.8 | (3) | (7) | A | B |

As is apparent from Tables 16 to 18, the combined use of the container and the compound of the invention causes little degradation of the joint section and almost no deterioration of the strength of the container even after its storage at a high temperature; particularly no degradation of the joint section was found at all in the oxygen transmittance of not more than 2.0 cc/m$^2$.day.atm. and no deterioration of the strength was found at all in the oxygen transmittance of not more than 1.0 cc/m$^2$.day.atm.

EXAMPLE 10

Of the Test No. 1-42 container in Example 90 the thicknesses of its LDPE and EVOH alone were changed to prepare containers having the water vapor transmission rate values shown in the following Table 19, and they were evaluated in the same manner as in Example 8. The results are shown in Table 19.

TABLE 19

| Test No. | Water vapor transmission rate (g/m$^2$ · day) | Degradation of joint section | Strength |
|---|---|---|---|
| 2-1 | 64.1 | B | B |
| 2-2 | 32.8 | B | B |
| 2-3 | 15.4 | B | B |
| 2-4 | 9.1 | A | B |
| 2-5 | 5.8 | A | B |
| 2-6 | 4.3 | A | A |
| 2-7 | 2.1 | A | A |
| 2-8 | 1.0 | A | A |

From Table 19 it is apparent that in the case of the water vapor transmission rate of not more than 10 g/m$^2$.day, no degradation of the joint section is found at all, while in the case of not more than 5 g/m$^2$.day, no deterioration of the strength occurs at all.

EXAMPLE 11

The following color-developing parts chemicals for processing color paper were filled in flexible containers in the same manner as in Example 9.

Color developer replenisher for color paper (for 10 liters)

Part A

The same as (2) of Example 9.

| | |
|---|---|
| Part B | |
| Potassium sulfite | 5 g |
| N-ethyl-N-β-methanesulfonamidoethyl-3-methyl-4-aminoaniline sulfate | 100 g |
| p-Toluenesulfonic acid | 30 g |
| Pure water to make 600 ml. | |
| Part C | |
| Potassium carbonate | 350 g |
| Potassium bromide | 0.5 g |
| Potassium hydroxide | 100 g |
| Sodium diethylenetriaminepentaacetic acid | 10 g |
| 1-Hydroxyethylidene-1,1-diphosphonic acid | 10 g |
| Pure water to make 800 ml. | |

To make a replenisher solution, the above parts A, B and C are added in the described order to be dissolved with stirring in 8.6 liters of water, and finally water is added again to make the whole 10 liters.

To make a starter solution, to the replenisher in an amount 70% of that of a starter solution-to-be are added 0.015 g of potassium bromide, 2.3 g of potassium chloride and 2.5 g of 50% sulfuric acid per liter thereof, and finally water is added to make the whole 100%.

Two kits of the above parts A, B and C were prepared, and one kit was stored at a temperature of 10° C., while the other was stored over a period of 3 weeks at a temperature of 50° C.

The stored kits were used to prepare two different color developer replenisher solutions for color paper, and from the kit that was stored at a lower temperature a starter was prepared. These were put in a CL-PP1701 printer/processor with a modified color developing bath, manufactured by KONICA Corp., to make running processing of Color Paper type QA-A5, produced by KONICA Corp., that was exposed through a wedge in the usual manner. In the running processing the bleach-fix and stabilizer solutions used are K-20P2R-01 and K-20P3R-01, produced by KONICA Corp. The two different color replenisher solutions were alternated with each other every 0.5 R, and running processing for 0.05 R per day was lasted until the amount of the replenished solution comes to 2.5 times the the color developer tank capacity, wherein the term 1 R implies that the color developer replenisher solution in a quantity corresponding to the color developer tank capacity is totally supplied for replenishment.

The processing steps are as follows:

| Processing step | Temperature | Time | Rep. amt |
|---|---|---|---|
| (1) Color develop | 38.0 ± 0.3° C. | 30 sec. | 81 ml/m$^2$ |
| (2) Bleach-fix | 35.0 ± 0.5° C. | 45 sec. | 216 ml/m$^2$ |
| (3) Stabilize (Tribath cascade) | 30–40° C. | 90 sec. | 248 ml/m$^2$ |
| (4) Dry | 60–80° C. | 30 sec. | |

During the duration of the running processing, the maximum cyan density was measured every 0.5 R as a reflection density at 640 nm. The results are shown in Table 20.

TABLE 20

| Test No. | Packaging material | Preservative-(exemplified cpd of Formula I) | Maximum cyan density Start | 0.5R | 1.0R | 1.5R | 2.0R | 2.5R |
|---|---|---|---|---|---|---|---|---|
| 3-1 (Comp.) | c | Diethyl hydroxylamine | 2.55 | 2.54 | 2.49 | 2.43 | 2.42 | 2.37 |
| 3-2 (Comp.) | h | Diethyl hydroxylamine | 2.55 | 2.53 | 2.58 | 2.44 | 2.56 | 2.42 |
| 3-3 (Comp.) | c | (2) | 2.63 | 2.62 | 2.58 | 2.52 | 2.49 | 2.41 |
| 3-4 (Inv.) | h | (2) | 2.62 | 2.64 | 2.61 | 2.63 | 2.62 | 2.63 |
| 3-5 (Comp.) | c | (7) | 2.62 | 2.63 | 2.59 | 2.55 | 2.51 | 2.43 |
| 3-6 (Inv.) | h | (7) | 2.63 | 2.64 | 2.62 | 2.64 | 2.62 | 2.62 |

From Table 20 it is understood that the combined use of the container and the preservative of the invention causes little or no deterioration or change in the color density and retains an always stable processability. Namely, the invention enables the obtaining of an always constant processability regardless of storing conditions of the kit chemicals.

EXAMPLE 12

The following color-developing parts chemicals for color negative films were filled in flexible containers in the same manner as in Example 9.

| Color developer replenisher for color negative films (for 10 liters) | |
|---|---|
| Part A | |
| Potassium sulfite | 60 g |
| Sodium diethylenetriaminepentaacetate | 30 g |
| Sodium bromide | 3.7 g |
| Potassium carbonate | 350 g |
| Potassium hydrogencarbonate | 5 g |
| Pure water to make 1 liter. | |
| Part B | |
| The same as (1) of Example 9 | |
| Part C | |
| Potassium sulfite | 10 g |
| 4-Amino-3-methyl-N-ethyl-β-(hydroxy)-ethylaniline sulfate | 60 g |
| Pure water to make 200 ml. | |

To make a replenisher solution, the above parts A, B and C are added in the described order to be dissolved in 8 liters of water, and further water is added to make the whole 10 liters.

To make a starter solution, to the replenisher solution in an amount 76% of that of a starter solution-to-be are added 0.9 g of potassium bromide and 0.6 mg of potassium iodide per liter thereof, and pH of it is adjusted to 10.01.

Two kits of the above parts were prepared; one kit was stored at a temperature of 10° C., while the other at a temperature of 50° C. for three weeks.

The stored kits were used to prepare two different color developer replenishers for processing color negative films, and from the kit that was stored at a lower temperature a starter solution was prepared. These were put in a CL-KP-50QA negative film processor, manufactured by KONICA Corp., to make running processing of Color Negative Film Super DD-100, produced by KONICA Corp., exposed through a wedge in the usual manner. In the above running processing, the bleaching, fixing and stabilizing solutions used are K-52N2R-01, K-52M3R-01 and K-52N4R-01, respectively. The two different color developer replenisher solutions were alternated with each other every 0.5 R, and the running processing was made for 0.05 R/day and lasted until the quantity of the replenished liquid comes to 2.5 times the tank capacity.

The processing steps used are as follows:

| Processing step | Time | Temperature | Rep. amt. |
|---|---|---|---|
| Color-develop | 3 min. 15 sec. | 38° C. | 536 ml/m$^2$ |
| Bleach | 45 sec. | 38° C. | 134 ml/m$^2$ |
| Fix | 1 min. 30 sec. | 38° C. | 536 ml/m$^2$ |
| Stabilize (Tribath cascade) | 1 min. 30 sec. | 38° C. | 500 ml/m$^2$ |
| Dry | | 40–70° C. | |

During the duration of the running processing, the maximum cyan density, as a reflection density at 640 nm, was measured every 0.5 R. The results are shown in Table 21.

TABLE 21

| Test No. | Packaging material | Preservative (exemplified cpd of Formula I) | Maximum cyan density Start | 0.5R | 1.0R | 1.5R | 2.0R | 2.5R |
|---|---|---|---|---|---|---|---|---|
| 4-1 (Comp.) | c | Hydroxylamine sulfate | 1.88 | 1.86 | 1.84 | 1.76 | 1.73 | 1.65 |
| 4-2 (Comp.) | h | Hydroxylamine sulfate | 1.89 | 1.87 | 1.92 | 1.83 | 1.88 | 1.79 |
| 4-3 (Comp.) | c | (2) | 1.96 | 1.94 | 1.90 | 1.85 | 1.82 | 1.76 |
| 4-4 (Inv.) | h | (2) | 1.96 | 1.97 | 1.95 | 1.94 | 1.96 | 1.95 |
| 4-5 (Comp.) | c | (7) | 1.99 | 1.96 | 1.93 | 1.84 | 1.81 | 1.77 |
| 4-6 (Inv.) | h | (7) | 2.00 | 1.98 | 1.97 | 1.96 | 1.99 | 1.97 |

As is apparent from Table 21, the combined use of the container and the preservative of the invention causes little deterioration or almost no change in the color density and retains an always stable processability. That is, the invention enables the obtaining of always stable processing characteristics of the kit regardless of its storage conditions.

LDPE: Low-density polyethylene
OPP: Oriented polypropylene
ONy: Oriented nylon
Ny: Non-oriented nylon
k-ONy: Vinylidene chloride-coated oriented nylon
PVA: Polyvinyl alcohol
EVOH: Ethylene-vinyl alcohol copolymer resin
LLDPE: Linear low-density polyethylene
PET: Polyethylene terephthalate
S.PE: Sand polyethylene

| Test No. | Form of container | Ammonium ion/whole cations ratio (mol %) | Swelling degree of container | Ease of opening | Deposit on bottle cap | Deposit on inside wall |
|---|---|---|---|---|---|---|
| 1-1 (Comp.) | PB | 20 | A | A | C | Present |
| 1-2 (Comp.) | GB | 20 | A | A | C | None |
| 1-3 (Inv.) | SP | 20 | A | A | — | None |
| 1-4 (Inv.) | SP | 0 | A | A | — | None |
| 1-5 (Inv.) | SP | 10 | A | A | — | None |
| 1-6 (Inv.) | SP | 30 | B | B | — | None |
| 1-7 (Inv.) | SP | 50 | B | B | — | None |
| 1-8 (Comp.) | SP | 70 | C | C | — | None |
| 1-9 (Comp.) | SP | 90 | C | C | — | None |

EXAMPLE 13

| Preparation of a fixing chemicals kit for color negative films | |
|---|---|
| Ammonium (or sodium) thiosulfate | 0.8 mol |
| Ammonium (or sodium) thiocyanate | 2.2 mol |
| Ammonium (or sodium) sulfite | 10.0 g |
| Disodium ethylenediaminetetraacetate | 1.0 g |

Kit samples were prepared with the kind of the above salt (ammonium salt or sodium salt) changed so as to obtain the ratio (mol%) of ammonium ions to the total cations as shown in the following table.

Further, ammonia water or a sodium hydroxide solution was used to adjust pH to 7.0 and water was added to make the whole one liter.

One liter of the above prepared solution was filled in each of the invention's flexible containers (also called 'standing pouch' due to its form, abbreviated to SP. The standing pouch's composition used in this test is comprised of PET12μ/Ny5μ/EVOH5μ/Ny5μ/LLDPE5μ/S.PE20μ/HDPE40μ/S.PE20μ/LLDPE-80μ; the same shall apply hereinafter), a conventional plastic bottle (PB, made of LDPE 50 μm), and a glass bottle (GB), and these were allowed to stand at 50° C. over a period of one month. After the one-month storage, the degrees of swelling of and of deposition on the cap and inside wall of each container were examined visually. The results are given below.

The symbols represent as follows:

The symbols used for evaluation define as follows:

Swelling degree of container

A: Little or no swelling is found.

B: The container is found swollen, but still stretchable.

C: The container is swollen up to its limit and cannot stretch any longer.

Ease of opening

A: The container can be easily opened in the usual manner with no gas leakage.

B: The container can be opened, but slight gas leakage occurs.

C: It is difficult to open the container with the possibility that its filled gas could burst out to attack the operator.

It is apparent from the above results that the ratio of ammonium ions to the whole cations in the invention, when not more than 50 mol %, brings good results, and when not more than 20 mol %, brings better results to any of the testing items.

The similar results were obtained also when using ammonium and potassium ions, and further even when using a mixture of ammonium, potassium and sodium ions as the cations.

Tests were made in like manner except that the standing pouch's layer composition was replaced by the following one, and almost the same results were obtained.

Layer composition:

PET12μ/Ny5μ/EVOH5μ/Ny5μ/LLDPE25μ/S.-PE20μ/LLDPE80μ

EXAMPLE 14

Preparation of a bleach-fix chemicals kit for color paper

Of the following parts of the bleach-fix chemicals kit for color paper, Part A alone was prepared for 4 liters of a replenisher solution. The prepared part was filled in standing pouches of the invention, a conventional plastic bottle and a glass bottle in the same manner as in Example 13, and then stored at 50° C. over a period of one month. After that, the containers were examined visually with respect to the swelling degree and the degree of crystal deposition on the cap and inside wall thereof. The results are shown below.

| Bleach-fix chemicals kit | |
|---|---|
| Part A | |
| Ammonium (or sodium) thiosulfate | 2.0 mols |
| Ammonium (or sodium) sulfite | 1.0 mol |
| Ammonium (or sodium) metasulfite | 1.0 mol |
| Pure water to make 800 ml. | |
| Part B | |
| Ferric-ammonium ethylenediaminetetraacetate dihydrate | 220 g |
| Ethylenediaminetetraacetic acid | 12 g |
| Pure water to make 680 ml. | |
| Part C | |
| 90% actic acid | 0.22 mol |
| Pure water to make 300 ml. | |

| Test No. | Form of container | Ammonium ion/whole cations ratio (mol %) | Swelling degree of container | Ease of opening | Deposit on bottle cap | Deposit on inside wall |
|---|---|---|---|---|---|---|
| 2-1 (Comp.) | PB | 20 | A | A | Present | Present |
| 2-2 (Comp.) | GB | 20 | A | A | Present | None |
| 2-3 (Inv.) | SP | 20 | A | A | — | None |
| 2-4 (Inv.) | SP | 0 | A | A | — | None |
| 2-5 (Inv.) | SP | 10 | A | A | — | None |
| 2-6 (Inv.) | SP | 30 | B | A | — | None |
| 2-7 (Inv.) | SP | 50 | B | B | — | None |
| 2-8 (Comp.) | SP | 70 | B | C | — | None |
| 2-9 (Comp.) | SP | 90 | C | C | — | None |

The symbols used are the same as defined in Example 13.

As is apparent from the above results, the ratio of ammonium ions to the whole cations in the invention, when not more than 50 mol %, brings good results, and when not more than 20 mol %, brings better results to any of the testing items.

The similar results were obtained also when using ammonium and potassium ions, and further even when using a mixture of ammonium, potassium and sodium ions as the cations.

Tests were made in like manner except that the standing pouch's layer composition was replaced by the following one, and almost the same results were obtained.

Layer composition:

PET12μ/Ny5μ/EVOH5μ/Ny5μ/LLDPE25μ/S.-PE20μ/LLDPE80μ

EXAMPLE 15

A color negative film as described in Japanese patent Application No. 288992/1991, as a test sample, was exposed through an optical wedge in the usual manner, and then subjected to running processing according to the following processing steps.

| Processing step | Time | Temperature | Rep. amt. |
|---|---|---|---|
| Color develop | 3 min. 15 sec. | 38° C. | 775 ml/m$^2$ |
| Bleach | 45 sec. | 38° C. | 155 ml/m$^2$ |
| Fix | 1 min. 30 sec. | 38° C. | 400 ml/m$^2$ |
| Stabilize | 50 sec. | 38° C. | 270 ml/m$^2$ |
| Dry | 1 min. | 40–70° C. | |

The stabilizing in the above processing was made in a 4-bath counter-current system, in which the stabilizer replenisher solution was first supplied to the final bath (4th bath) to have its liquid overflowed through the preceding third and second baths up to the first bath. The overflow from the first bath was all flowed into the fixing bath.

| Color developer | |
|---|---|
| Potassium carbonate | 30 g |
| Sodium hydrogen carbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-Amino-3-methyl-N-ethyl-N-(β-hydroxyethyl)-aniline sulfate | 4.5 g |
| Diethylenetriaminepentaacetic acid | 3.0 g |
| Potassium hydroxide | 1.2 g |
| Water to make 1 liter. | |
| Adjust pH to 10.0 with potassium hydroxide or 20% sulfuric acid. | |

| Color developer replenisher | |
|---|---|
| Potassium carbonate | 35 g |
| Sodium hydrogen carbonate | 3 g |
| Potassium sulfite | 5 g |
| Potassium bromide | 0.5 g |
| Hydroxylamine sulfate | 3.5 g |
| 4-Amino-3-methyl-N-ethyl-N-(β-hydroxyethyl)-aniline sulfate | 6.0 g |
| Potassium hydroxide | 2 g |
| Diethylenetriaminepentaacetic acid | 3.0 g |
| Water to make 1 liter. | |
| Adjust pH to 10.12 with potassium hydroxide or 20% sulfuric acid. | |
| Bleaching bath | |
| Ferric 1,3-propylenediaminetetraacetate | 0.32 mol |
| Disodium ethylenediaminetetraacetate | 0.03 mol |
| Ammonium bromide | 1.0 mol |
| Glacial acetic acid | 0.67 mol |
| Ammonium nitrate | 0.5 mol |
| Water to make 1 liter. | |
| Adjust pH to 4.4 with ammonia water or glacial acetic acid. | |
| Bleaching bath replenisher | |
| Ferric 1,3-propylenediaminetetraacetate | 0.35 mol |
| Disodium ethylenediaminetetraacetate | 0.006 mol |
| Ammonium bromide | 1.2 mols |
| Glacial acetic acid | 0.67 mol |
| Ammonium nitrate | 0.6 mol |
| Water to make 1 liter. | |

-continued

| |
|---|
| Adjust pH to 3.4 with ammonia water or glacial acetic acid. |

Fixer bath and fixer replenisher

The foregoing fixing chemicals kit in Example 13 was filled in containers in the foregoing different forms to be stored at 50° C. for one month, and after that, these were used.

| Stabilizer bath and stabilizer replenisher | |
|---|---|
| m-Hydroxybanzaldehyde | 2 g |
| Diethylene glycol | 10 g |
| p-Nonylphenyl-ethylene oxide 10-mol adduct | 1 g |
| Adjust pH to 8.0 with potassium hydroxide or 20% sulfuric acid, and add water to make 1 liter. | |

The running processing was lasted until the replenished amount comes to three times the tank capacity. After completion of the running processing, wedge-exposed samples were processed in the replenished solutions to measure the residual silver amount remaining in the unexposed area thereof and also to visually examine the deposition or suspension inside the tank.

The results are shown below:

| Test No. | Form of container | Ammonium ion/ total cations ratio (mol %) | Residual Ag in unexposed area (mg/dm$^2$) | Deposition/ suspension |
|---|---|---|---|---|
| 3-1 (Comp.) | PB | 20 | 1.8 | C |
| 3-2 (Comp.) | GB | 20 | 1.6 | C |
| 3-3 (Inv.) | SP | 20 | 0.0 | A |
| 3-4 (Inv.) | SP | 0 | 0.0 | A |
| 3-5 (Inv.) | SP | 30 | 0.2 | A |
| 3-6 (Inv.) | SP | 50 | 0.3 | A |
| 3-7 (Comp.) | SP | 70 | 0.6 | A |
| 3-8 (Comp.) | SP | 90 | 1.1 | B |

The deposition/suspension evaluation is as follows:

A: No deposition/suspension at all.

B: Slight deposition/suspension.

C: Much deposition/suspension.

As is apparent from the above results, the ratio of ammonium ions to the whole cations in the invention, when not more than 50 mol %, brings good results, and when not more than 20 mol %, brings better results to photographic processing characteristics.

The similar results were obtained also when using ammonium and potassium ions, and further even when using a mixture of ammonium, potassium and sodium ions as the cations.

Tests were made in like manner except that the standing pouch's layer composition was replaced by the following one, and almost the same results were obtained.

Layer composition:

PET12μ/Ny5μ/EVOH5μ/Ny5μ/LLDPE25μ/S.-PE20μ/LLDPE80μ

EXAMPLE 16

A color photographic paper as described in Japanese Patent Application No. 330735/1991, as a test sample, was exposed through an optical wedge in the usual manner, and then subjected to running processing according to the following processing steps.

| Processing step | Temperature | Time | Rep. amt. |
|---|---|---|---|
| (1) Color develop | 35.0 ± 0.3° C. | 45 seconds | 162 ml/m$^2$ |
| (2) bleach-fix | 35.0 ± 0.5° C. | 45 seconds | 100 ml/m$^2$ |
| (3) Stabilize (Tribath cascade) | 30–34° C. | 90 seconds | 248 ml/m$^2$ |
| (4) Dry | 60–80° C. | 30 seconds | |

| Color developer | |
|---|---|
| Diethylene glycol | 15.0 g |
| N,N-diethylhydroxylamine | 3.6 g |
| Hydrazinodiacetic acid | 5.0 g |
| Potassium bromide | 20 mg |
| Potassium chloride | 2.5 g |
| Diethylenetriaminepentaacetic acid | 5 g |
| Potassium sulfite | 5.0 × 10$^{-4}$ mol |
| 3-Methyl-4-amino-N-ethyl-N-(β-methanesulfonamidoethyl)-aniline sulfate | 5.5 g |
| Potassium carbonate | 25 g |
| Potassium hydrogencarbonate | 5 g |
| Water to make 1 liter. | |
| Adjust pH to 10.10 with potassium hydroxide or sulfuric acid. | |
| **Color developer replenisher** | |
| Diethylene glycol | 15.0 g |
| N,N-diethylhydroxylamine | 5 g |
| Hydrazinodiacetic acid | 7.5 g |
| Potassium bromide | 8 mg |
| Potassium chloride | 0.3 g |
| Diethylenetriaminepentaacetic acid | 7.5 g |
| Potassium sulfite | 7.0 × 10$^{-4}$ mol |
| 3-Methyl-4-amino-N-ethyl-N-(β-methanesulfonamidoethyl)-aniline sulfate | 8 g |
| Potassium carbonate | 30 g |
| Potassium hydrogencarbonate | 1 g |
| Water to make 1 liter. | |
| Adjust pH to 10.40 with potassium hydroxide or sulfuric acid. | |
| **Bleach-fix bath** | |
| Ferric ethylenediaminetetraacetate | 0.15 mol |
| Ethylenediaminetetraacetic acid | 0.01 mol |
| Ammonium thiosulfate | 1.0 mol |
| Ammonium sulfite | 0.1 mol |
| Ammonium bromide | 0.1 mol |
| Water to make 1 liter. | |
| Adjust pH to 6.5 with ammonia water or glacial acetic acid. | |

Bleach-fix replenisher

The Part A of the bleach-fix chemicals kit described in Example 14 was filled in containers in the respective forms to be stored at 50° C. for a period of one month. The stored chemicals Part A in each container was mixed with Part B and Part C, and pure water was added thereto to make the whole 4 liters to be used.

| Stabilizing bath and replenisher | |
|---|---|
| o-Phenyl-phenol | 0.1 g |
| Uvitex MST (produced by Ciba Geigy) | 1.0 g |
| Zinc sulfate, heptahydrate | 0.1 g |
| Ammonium sulfite | 0.02 mol |
| 1-Hydroxyethylidene-1,1-diphosphonic acid (60% solution) | 3.0 g |
| Ethylenediaminetetraacetic acid | 1.5 g |

-continued

| Stabilizing bath and replenisher |
|---|
| Water to make 1 liter. |
| Adjust pH to 7.8 with ammonia water or sulfuric acid |

The running processing was lasted until the replenished amount comes to three times the tank capacity.

After completion of the running processing, wedge-exposed samples were processed in the replenished solutions to measure the residual silver remaining in the unexposed area thereof and also to visually examine the deposition or suspension inside the tank.

The results are shown below:

| Test No. | Form of container | Ammonium ion/ total cations ratio (mol %) | Residual Ag in unexposed area (mg/dm$^2$) | Deposition/ suspension |
|---|---|---|---|---|
| 3-1 (Comp.) | PB | 20 | 1.1 | C |
| 3-1 (Comp.) | PB | 20 | 1.1 | C |
| 3-2 (Comp.) | GB | 20 | 1.0 | C |
| 3-3 (Inv.) | SP | 20 | 0.0 | A |
| 3-4 (Inv.) | SP | 0 | 0.0 | A |
| 3-5 (Inv.) | SP | 30 | 0.1 | A |
| 3-6 (Inv.) | SP | 50 | 0.2 | A |
| 3-7 (Comp.) | SP | 70 | 0.5 | B |
| 3-8 (Comp.) | SP | 90 | 0.8 | B |

The deposition/suspension evaluation was made in the same manner as in Example 15.

As is apparent from the above results, the ratio of ammonium ions to the whole cations in the invention, when not more than 50 mol % brings good results, and when not more than 20 mol %, brings better results to photographic processing characteristics.

The similar results were obtained also when using ammonium and potassium ions, and further even when using a mixture of ammonium, potassium and sodium ions as the cations.

Tests were made in like manner except that the standing pouch's layer composition was replaced by the following one, and almost the same results were obtained.

Layer composition:

PET12μ/Ny5μ/EVOH5μ/Ny5μ/LLDPE25μ/S.-PE20μ/LLDPE80μ

EXAMPLE 17

Tests were made in like manner except that the component materials and their thicknesses used for the No.6 film in Table 1 of Example 1 were changed as shown in the following Table A, and the obtained photographic characteristics (color paper: unexposed area's yellow reflection densities) were evaluated. The results were much the same as in Example 1

TABLE A

| No. | | In contact with sol. (Inner) . . . Outer | |
|---|---|---|---|
| A-1 | Component material | LTDPE/S.PE/LLDPE/Ny/EVOH/Ny/LLDPE/PET | Invention |
| | Thickness (μ) | 80/20/5/5/5/5/5/12 | |
| A-2 | Component material | LLDPE/S.PE/LLDPE/Ny/EVOH/Ny/LLDPE/PET | Invention |
| | Thickness (μ) | 160/20/5/5/5/5/5/12 | |

What is claimed is:

1. A photographic processing chemicals kit comprising a solution contained in a sealed flexible container, wherein said solution is a bleaching agent comprising a compound represented by Formula B:

Formula B $X_2$—A—COOM$^3$ wherein $X_2$ represents a hydroxyl group, a halogen atom, an amino group or a —COOM$^3$ group, A represents an alkylene group, M$^3$ represents a hydrogen atom, an ammonium group, an alkali metal atom or an organic ammonium group, and said flexible container is composed of a multilayer film comprising at least one layer of a polyolefin resin or a polyethylene-vinyl acetate copolymer resin, and at least one layer of a resin selected from the group consisting of:

A. ethylene-vinyl alcohol copolymer resins,

B. polyamide resins,

C. acrylonitrile resin,

D. polyethylene terephthalate resin,

E. polyhalogenated vinylidene resin,

F. polyhalogenated vinyl resin,

G. polyethylene resin deposited with ceramic, and

H. polyethylene terephthalate resin deposited with ceramic.

2. The photographic processing chemicals kit of claim 1, wherein the water vapor transmission rate of the multilayer film is not more than 20 g/m$^2$.day.

3. The photographic processing chemicals kit of claim 1 or claim 2, wherein the oxygen transmittance of the multilayer film is not more than 5 ml/m$^2$.day.atm.

4. The photographic processing chemicals kit of claim 3, wherein the volume of said chemicals kit is not more than 3 liters.

5. The photographic processing chemicals kit of claim 1, wherein the volume of said chemicals kit is not more than 3 liters.

6. The photographic processing chemicals kit of claim 1, wherein the multilayer film comprises at least one polyolefin resin layer and at least one ethylene-vinyl alcohol copolymer resin layer.

7. The photographic processing chemicals kit of claim 1, wherein the multilayer film comprises at least one polyolefin resin layer and at least one layer of polyethylene resin deposited with ceramic or polyethylene terephthalate resin deposited with ceramic.

8. The photographic processing chemicals kit of claim 1, wherein the multilayer film comprises at least one polyolefin resin layer and at least one polyamide resin layer.

9. The photographic processing chemicals kit of claim 1, wherein a thickness of said flexible container is within the range of 40 μm to 500 μm.

10. The photographic processing chemicals kit of claim 1, wherein a thickness of said flexible container is within the range of 100 μm to 300 μm.

11. A photographic processing chemicals kit comprising a processing agent contained in a sealed flexible container, wherein said container is composed of one multilayer film comprising at least one layer of a resin selected from a polyolefin resin or a polyethylene-vinyl acetate copolymer resin, and at least one layer of a resin selected from the group consisting of:

A. ethylene-vinyl alcohol copolymer resin,

B. polyamide resin,

C. acrylonitrile resin,

D. polyethylene terephthalate resin,

E. polyhalogenated vinylidene resin,

F. polyhalogenated vinyl resin, and

G. polyethylene resin deposited with ceramic, and

H. polyethylene terephthalate resin deposited with ceramic; polyethylene or polyethylene terephthalate film deposited with ceramic;

wherein the water vapor transmission rate of the multilayer film is not more than 20 $g/m^2$.day, and the oxygen transmittance of the multilayer film is not more than 5 $ml/m^2$.day.atm, and said processing agent is a bleaching agent comprising at least one compound represented by Formula B:

Formula B $$X_2—A—COOM^3$$

wherein $X_2$ represents a hydroxyl group, a halogen atom, an amino group or a $—COOM^3$ group, A represents an alkylene group, $M^3$ represents a hydrogen atom, an ammonium group, an alkali metal atom or an organic ammonium group.

* * * * *